US007303306B2

(12) United States Patent
Ross et al.

(10) Patent No.: US 7,303,306 B2
(45) Date of Patent: Dec. 4, 2007

(54) MULTI-PURPOSE FLASHLIGHT DEVICE AND METHOD OF USING SAME

(75) Inventors: Jeremy B. Ross, Savoy, IL (US); Gavin A. Steele, White Heath, IL (US)

(73) Assignee: First-Light USA, LLC, Seymour, IL (US)

( * ) Notice: Subject to any disclaimer, the term of this patent is extended or adjusted under 35 U.S.C. 154(b) by 0 days.

(21) Appl. No.: 11/261,027

(22) Filed: Oct. 28, 2005

(65) Prior Publication Data

US 2006/0050502 A1 Mar. 9, 2006

Related U.S. Application Data

(63) Continuation-in-part of application No. 10/775,943, filed on Feb. 10, 2004.

(60) Provisional application No. 60/446,183, filed on Feb. 10, 2003, provisional application No. 60/699,140, filed on Jul. 14, 2005.

(51) Int. Cl.
*F21L 4/00* (2006.01)

(52) U.S. Cl. ..... 362/191; 362/103; 362/109

(58) Field of Classification Search ..... 362/190, 362/191, 105, 103, 108, 396, 109–112; 224/101–272
See application file for complete search history.

(56) References Cited

U.S. PATENT DOCUMENTS

| | | | | |
|---|---|---|---|---|
| 1,119,663 A | | 12/1914 | Swallow | |
| 1,267,436 A | | 5/1918 | Martin | |
| 1,307,456 A | | 6/1919 | Prahar | |
| 1,338,222 A | * | 4/1920 | Hazelett | 362/194 |
| 1,527,792 A | | 2/1925 | French | |
| 1,599,499 A | | 9/1926 | St. John | |
| 1,763,815 A | | 6/1930 | Pajeau | |
| 1,879,622 A | * | 9/1932 | Jones | 362/197 |
| 1,893,108 A | | 1/1933 | Shannon | 362/199 |

(Continued)

FOREIGN PATENT DOCUMENTS

EP 0484891 5/1992

(Continued)

OTHER PUBLICATIONS

Picatinny 1913 Rail Specifications, http://www.biggerhammer.net/picatinny/, printed Jul. 8, 2005, 3 pages, date of first publication unknown.

(Continued)

*Primary Examiner*—Sandra O'Shea
*Assistant Examiner*—Gunyoung T. Lee
(74) *Attorney, Agent, or Firm*—Doug Rommelmann; Andrews Kurth LLP

(57) ABSTRACT

Disclosed is a preferred flashlight device configured for potential use with another item such as a firearm or in activities where some manual dexterity of the hand grasping the flashlight is required. Preferred devices include downwardly-extending light and handle portions, interconnected by a linking member. Preferred devices include movable connections between the light and handle members and the linking member, so that the direction of a beam emanating from the flashlight can be optimized to an activity undertaken while holding the flashlight, for example during a two-handed pistol firing position.

15 Claims, 21 Drawing Sheets

U.S. PATENT DOCUMENTS 1,906,193 A 4/1933 Vitale
1,986,281 A 1/1935 Nygard ..... 362/197
2,132,063 A 10/1938 Whaley
2,265,610 A 12/1941 Morgan
2,356,396 A 8/1944 Gonseor
2,450,584 A 10/1948 Dodge
2,588,036 A 3/1952 O'Quinn
2,629,045 A 2/1953 Frohlich
2,948,806 A * 8/1960 Anderson ..... 362/190
3,112,889 A 12/1963 Marmo et al.
3,601,595 A * 8/1971 Kivela ..... 362/190
3,628,005 A 12/1971 Rhoades ..... 362/191
3,970,228 A 7/1976 Keller
4,345,304 A 8/1982 Penny et al. ..... 362/183
4,348,716 A 9/1982 Storm et al.
4,425,600 A 1/1984 Barnhart
4,447,863 A 5/1984 Fenne
4,459,646 A 7/1984 Drane
4,533,982 A 8/1985 Kozar
4,542,447 A 9/1985 Quakenbush
4,977,489 A 12/1990 Fung
4,999,750 A 3/1991 Gammache
5,019,951 A 5/1991 Osterhout et al. ..... 362/191
5,040,322 A 8/1991 Iturrey, Jr.
5,064,988 A 11/1991 E'nama et al.
5,086,377 A 2/1992 Roberts
5,097,399 A 3/1992 Gammache
5,161,095 A 11/1992 Gammache
5,167,446 A 12/1992 Haroutunian
5,190,369 A 3/1993 Pace
5,239,451 A * 8/1993 Menke et al. ..... 362/199
5,265,781 A 11/1993 Nichols
5,278,739 A 1/1994 Gammache
5,345,368 A 9/1994 Huff
5,363,285 A 11/1994 Wideman
5,410,457 A 4/1995 Parker
5,429,119 A 7/1995 Griffin et al.
5,448,458 A 9/1995 Smyly, Jr.
5,522,167 A 6/1996 Teetzel
5,530,633 A 6/1996 Yuen
5,533,657 A 7/1996 Rosen et al.
5,541,822 A 7/1996 Bamber
5,556,003 A 9/1996 Johnson et al.
5,558,430 A 9/1996 Booty, Jr. ..... 362/184
5,568,971 A 10/1996 Jewell
5,570,948 A 11/1996 Menke et al.
5,580,157 A 12/1996 Patricca et al.
5,584,137 A 12/1996 Teetzel
5,593,074 A 1/1997 Matthews
5,628,555 A 5/1997 Sharrah et al.
5,632,548 A 5/1997 Mayfarth
5,642,932 A 7/1997 Matthews
5,685,105 A 11/1997 Teetzel
5,720,543 A 2/1998 Sheps
5,743,623 A 4/1998 Kerr
5,752,633 A 5/1998 Antaki
5,822,905 A 10/1998 Teetzel
5,848,834 A 12/1998 Kerr
5,859,582 A 1/1999 Yuen ..... 340/326
5,871,272 A 2/1999 Sharrah et al.
5,921,657 A * 7/1999 Case ..... 362/191
5,993,022 A 11/1999 Neyer et al.
6,012,824 A 1/2000 Sharrah et al.
6,023,875 A 2/2000 Fell et al.
6,213,619 B1 4/2001 Yu
6,220,720 B1 4/2001 Stephens
6,270,231 B1 8/2001 Kerr
6,315,426 B1 11/2001 Buller
6,322,233 B1 11/2001 Brandt
6,523,972 B2 2/2003 Sharrah et al.
6,526,688 B1 3/2003 Danielson et al.
6,550,930 B1 4/2003 Portouche
6,612,714 B1 9/2003 Morre et al.
6,644,827 B2 11/2003 Birdwell
6,659,621 B2 12/2003 Sharrah et al.
6,761,467 B2 7/2004 Matthews et al.
6,817,730 B2 11/2004 Sharrah et al.
6,896,389 B1 * 5/2005 Paul ..... 362/105
6,916,104 B2 7/2005 Parsons et al.
2001/0048596 A1 12/2001 Kerr
2002/0172034 A1 11/2002 Lawless
2003/0058636 A1 3/2003 Smith
2004/0012954 A1 1/2004 Hart
2004/0032750 A1 2/2004 Watts et al.
2004/0052073 A1 3/2004 Chang et al.
2004/0055202 A1 3/2004 Oz
2004/0114373 A1 6/2004 Lin
2004/0198336 A1 10/2004 Jancic et al.
2004/0255361 A1 12/2004 Senter et al.

FOREIGN PATENT DOCUMENTS

EP 0721082 7/1996
GB 272758 6/1927

OTHER PUBLICATIONS

U.S. Department of Defense, Military Standard—Dimensioning of Accessory Mounting Rail for Small Arms Weapons, MIL-STD-1913 (AR), Feb. 13, 1995, http://www.biggerhammer.net/picatinny.
Dive Lights International, Inc., NiteRider® Dive Lights, http://www.niteriderdive.com, printed Dec. 12, 2005, 5 pages, date of first publication unknown.

* cited by examiner

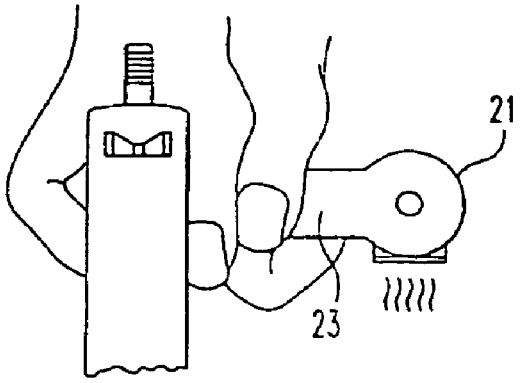
Fig. 6
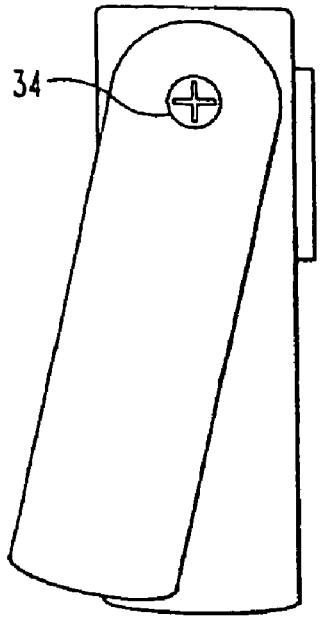
Fig. 7
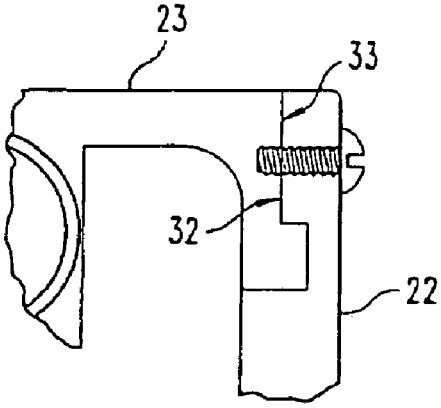
Fig. 8
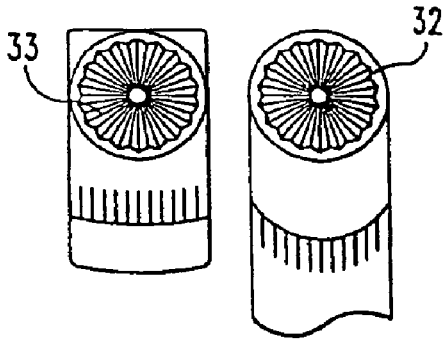
Fig. 9A
Fig. 9B

MULTI-PURPOSE FLASHLIGHT DEVICE AND METHOD OF USING SAME

CROSS-REFERENCE TO RELATED APPLICATIONS

This application is a continuation-in-part application of co-pending U.S. application Ser. No. 10/775,943, filed Feb. 10, 2004, which claims priority to U.S. Provisional Application Ser. No. 60/446,183, filed Feb. 10, 2003, which is hereby incorporated by reference in its entirety. The present application also claims priority to U.S. Provisional Application Ser. No. 60/699,140, filed Jul. 14, 2005.

BACKGROUND OF THE INVENTION

1. Field of the Invention

The present invention relates generally to flashlights and methods of using same, and in particular to a flashlight adapted for convenient use in conjunction with other hand-held implements, such as firearms, or in conjunction with activities requiring the use of one's hands.

2. Description of the Related Art

By way of background, a number of flashlights or flashlight holders are known that are designed for use in combat or self-defense situations. Several of these holders and flashlights are disclosed, for example, in U.S. Pat. Nos. 6,270,231; 5,848,834; 5,167,446; 4,542,447; 5,642,932; 5,363,285; 5,556,003; 5,345,368; 6,023,875; 5,752,633; 5,533,657; and 5,593,074. An additional such flashlight device is disclosed in EP0484891.

In spite of prior work in the area, there remain needs for improved flashlight devices for potential use in conjunction with other hand-held implements such as firearms, particularly in self-defense and/or combat situations, or when performing other tasks or activities that require two handed operation such as those that commonly occur in industrial environments or outdoor activities. The present invention is directed to these needs.

SUMMARY OF THE INVENTION

One aspect of the present invention provides a flashlight adapted for use in conjunction with a firearm, especially a handgun, having adaptations for optimally positioning the light during use. In one embodiment of the present invention, a flashlight device is provided having a downwardly-extending lightbox, a downwardly-extending handle portion, and a linking member connecting the lightbox and the handle portion. Illustratively, the handle portion and lightbox may depend from a generally horizontally extending linking member, to provide a flashlight form convenient for handling during a two-handed firearm firing position, other two-handed operations, or in general other activities which benefit from manual dexterity of the hand grasping the flashlight. In more preferred embodiments, the device is configured so the positions of the lightbox and handle portion are movable relative to one another to optimize adjustments for the user. For example, the lightbox and handle portion may be re-positionable relative to one another in vertical and/or horizontal planes. In a most preferred form, the invention provides a flashlight device wherein the lightbox and handle portion are both vertically and horizontally adjustable relative to one another so that a user can position the beam lower or higher, or to the left or the right, to provide an optimal direction for a light beam emanating from the lightbox, for example during a normal two-handed firing position of a pistol. The vertical and horizontal adjustments are desirably located on different portions of the flashlight device. For example, the lightbox may be rotatable in a horizontal plane relative to the linking member to which it is attached; and the handle portion can be rotatable in a vertical plane relative to the linking member to which it is attached.

Additional preferred embodiments as well as features and advantages of the invention will be apparent from the following descriptions.

BRIEF DESCRIPTION OF THE SEVERAL VIEWS OF THE DRAWINGS

A better understanding of the present invention can be obtained when the following detailed description of the disclosed embodiments is considered in conjunction with the following drawings, in which:

FIG. 6 is a top view of a flashlight device of the invention in use during a two-handed firing position;

FIG. 7 is a right side view of a flashlight device according to an embodiment of the present invention illustrating an offset angle between the handle portion and the lightbox of the device;

FIG. 8 is a cutaway view of a rotatable and lockable connection between a handle portion and a linking member of a flashlight device according to an embodiment of the present invention;

FIGS. 9A and 9B are views of the cooperating surface features on the linking member and handle portion, respectively, shown in FIG. 8, providing a rotatable/locking mechanism using meshable locking plates;

DESCRIPTION OF THE PREFERRED EMBODIMENTS

For the purpose of promoting an understanding of the principles of the invention, reference will now be made to certain preferred embodiments thereof and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

Figure 1:
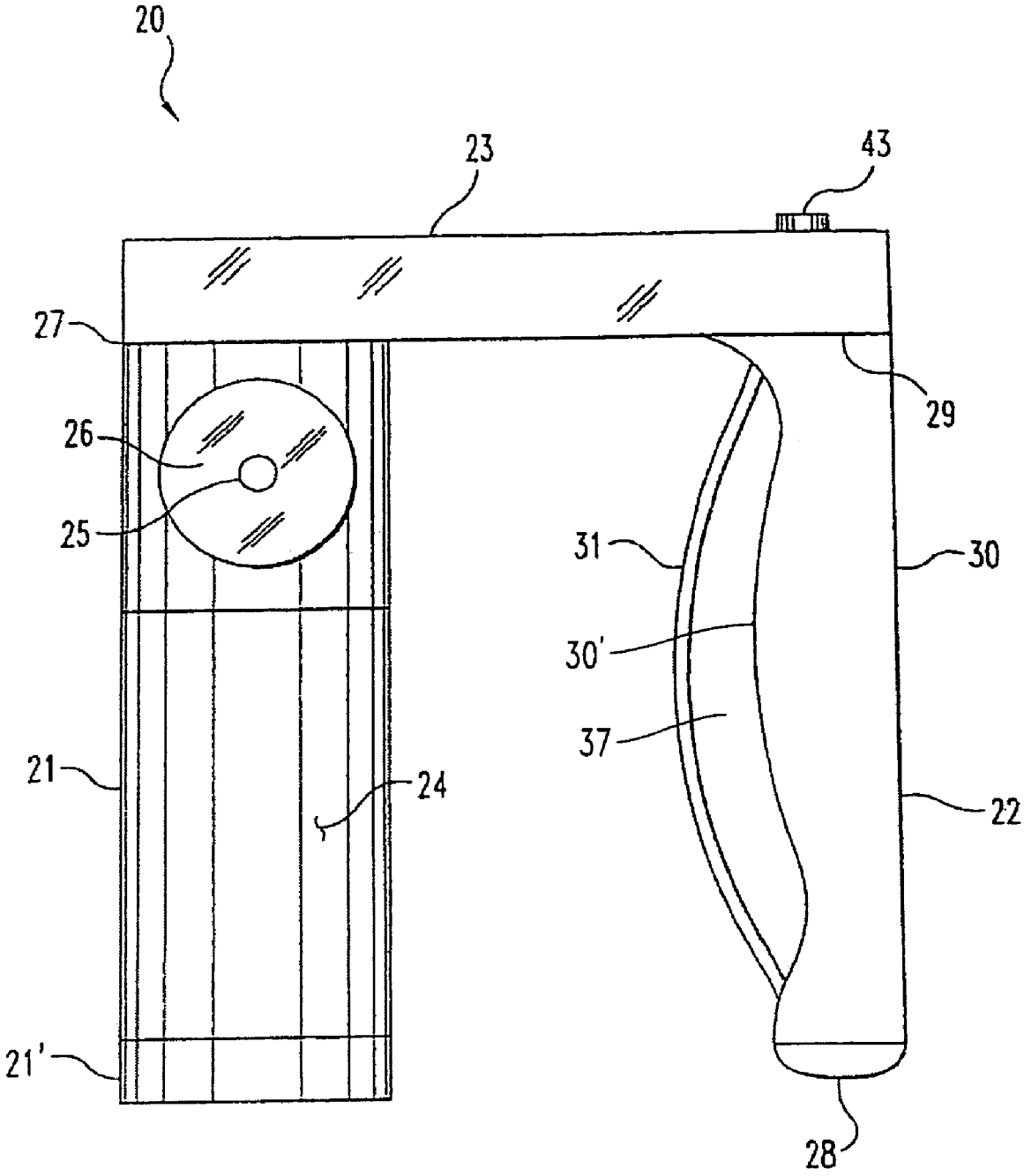
FIG. 1 is a front elevation view of a first embodiment of the flashlight device according to the present invention.

As disclosed above, the present invention provides flashlight devices and apparatuses suited for use in two-handed grasping operations or other operations where manual dexterity of the hand holding the flashlight is beneficial, for example in self-defense and/or combat situations, in industrial environments and/or in outdoor recreation. With reference to FIG. 1, shown is a front view of one preferred flashlight device 20 of the present invention. Flashlight device 20 includes a lightbox 21, generally downwardly-extending, a handle portion 22, generally downwardly-extending, and a linking member 23, generally transverse, connecting the lightbox 21 and handle portion 22. Preferably, lightbox 21 includes a generally cylindrical body 24 having mounted therein a light source 25 situated behind a lens 26, preferably formed with a relatively shatter-proof plastic material such as Lexmar. Light source 25 is energizeable by one or more batteries residing within the lightbox 21 as will be discussed herein below. Preferably, the light source 25 is capable of delivering at least about 20,000 candle power (CP), typically in the range of about 20,000 to about 50,000 CP. Higher or lower intensities may also be desirable for particular utilities for the flashlight device 20. The light source 25 may, for example, include a halogen, xenon or other pressurized gas bulb, or one or a plurality of light emitting diodes (LEDs); in one embodiment of the invention, the light source 25 includes a plurality of LEDs, for example 2, 3, 4, 5 or 6 or more LEDs.

Lightbox 21 is connected to linking member 23 at its first, or upper, end 27. Although this connection could be integral, it is preferred that the connection be a movable connection, for example providing for angular rotation about a longitudinal axis of the lightbox 21 so that a user of the flashlight 20 can adjust the direction of the light beam emanating from the light source 25 in a horizontal fashion.

Handle portion 22 includes a lower end 28 and an upper end 29, and a central portion 30 spanning between the lower end 28 and upper end 29. Central portion 30 can, if desired, have external adaptations to improved the ergonomic character of the handle portion 22. For example, central portion 30 may include one or more convex or concave sections. In one embodiment, as illustrated in FIG. 1, central portion 30 includes an inwardly-facing (toward the lightbox 21) convex portion 30' adapted to ergonomically cooperate with the palm of the hand in a firing position (see e.g. FIG. 3). If desired, handle portion 22 can be covered with or made of a material with a relatively high coefficient of friction compared to other portions of the flashlight device 20 to improve gripping properties. For example, handle portion 22 may be covered with a polymeric sleeve, including, e.g. an elastomeric sleeve such as a neoprene sleeve. As also shown in FIG. 1, handle portion 22 can incorporate a strap 31 extending inwardly from handle portion 22 to form a hand receiving opening 37 through which the user's hand can be placed while holding the flashlight 20.

Figure 3:
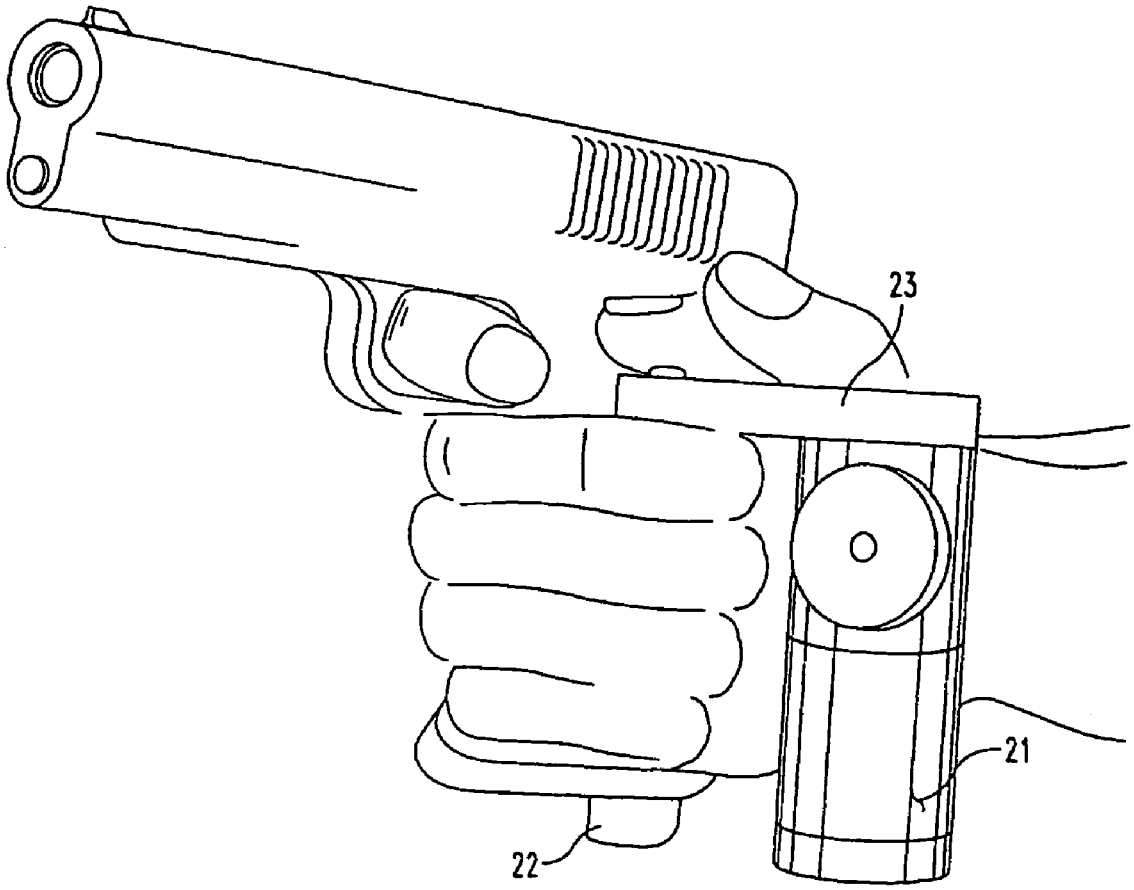
FIG. 3 is a perspective view of a flashlight device in use during a two-handed firing position in accordance with the present invention.

FIG. 3 illustrates the flashlight device 20 according to an embodiment of the present invention being used with a handheld firearm in a two-handed firing position. It is noted that the strap 31 has been omitted in FIG. 3. In FIG. 3, a right-handed user or shooter is shown with the shooter's right index finger on the trigger, the right thumb above the linking member 23 and the remaining three fingers on the right hand (not shown) curled around the firearm grip. Preferably, the handle portion 22 contacts the palm of the shooter's left hand with the linking member 23 extended overtop the hand and the lightbox 21 extended down the back side of the hand. Preferably, the left thumb is positioned above the linking member 23 and adjacent the right thumb and the other four fingers are curled around the firearm grip on top of the three curled right fingers. When held in this manner, the handle portion 22 is preferably in abutting relationship with the firearm grip. Alternatively, the three curled right fingers may be between the handle portion 22 and the firearm grip in which case the handle portion 22 abuts the three curled right fingers. The flashlight device 20 may be held in yet another manner with a handheld firearm. In this alternative technique, the four fingers on the left hand are curled around the handle portion 22 and abut the firearm grip or the three curled fingers of the right hand (see e.g. FIG. 6). When held in this manner, the handle portion 22 is not contacting the firearm grip.

Handle portion 22 is connected at its upper end 29 to linking member 23. Although this connection may be integral, it is preferred that this connection provide for movement of the two elements relative to one another. For example, in one preferred embodiment the handle portion 22 is pivotable relative to the linking member 23, and preferably pivotable in a plane generally transverse to the longitudinal axis of the linking member 23. In doing so, it is also preferred that the pivoted positions be lockable between the handle portion 22 and linking member 23. This locking or fixing of the positions may be facilitated, for example, by appropriate detent devices or, for example, by providing a first surface 32 of or connected to the handle portion 22, which cooperates with a second similar surface 33 connected to the linking member 23 (See e.g. FIGS. 8 and 9). Preferably, the two surfaces 32 and 33 have cooperating ridges, teeth or other interlocking members. While a connector such as a screw 34 (see FIG. 7) is positioned to allow separation between the plates, the handle portion 22 and linking member 23 can be pivoted relative to one another. Thereafter, when pivoted to the desired degree, the connector 34 is utilized to fix the two plates against one another so as to cause the interlocking members on the plates to mesh, and fix the position of the handle portion 22 and linking member 23 relative to one another. In this fashion, a user of the device 20 can adjust the vertical orientation of the light beam to optimize its direction during a normal two-handed firing position with a handgun (see e.g. FIG. 7).

Figure 2A:
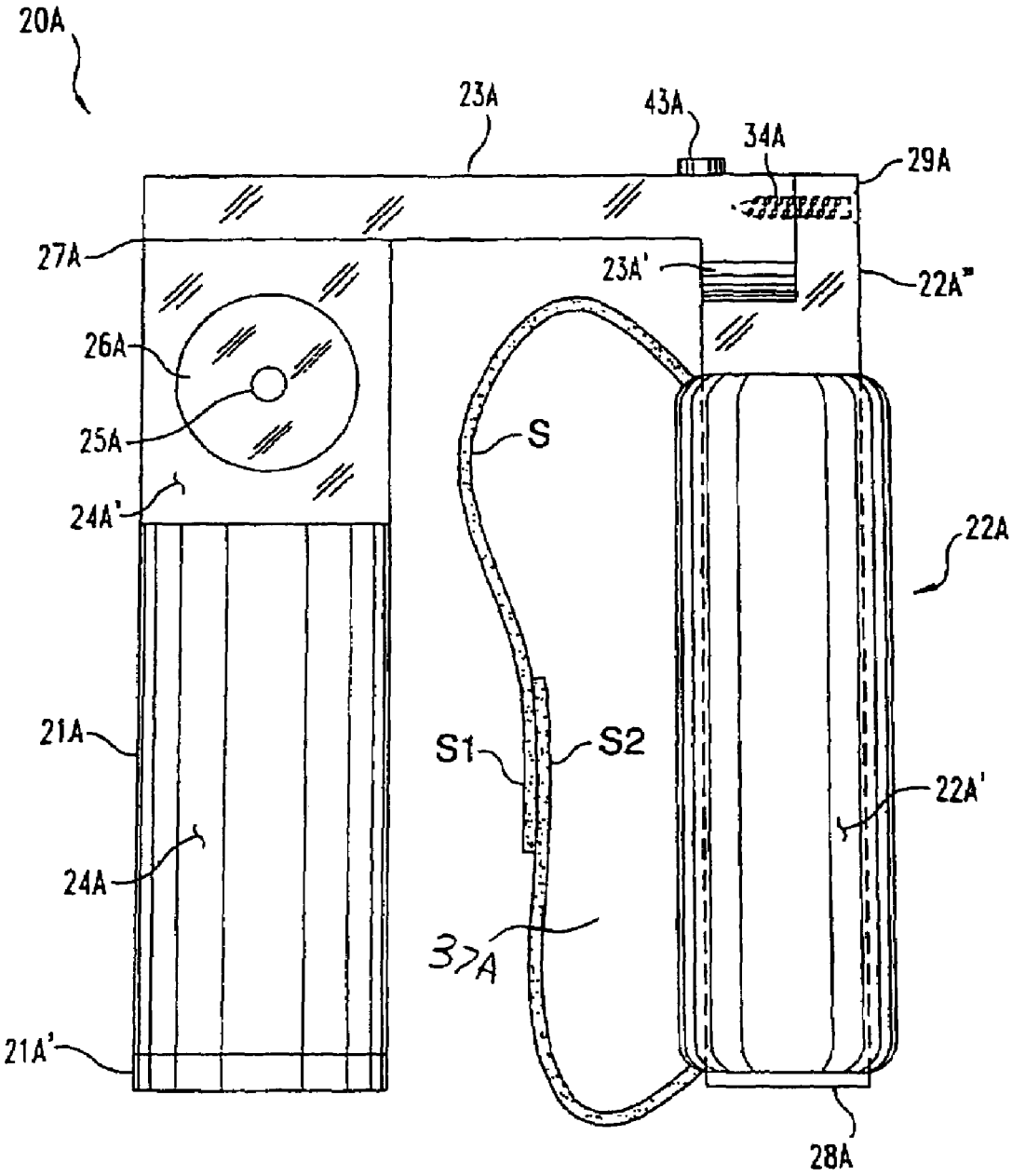
FIG. 2A is a front elevation view of a second embodiment of the flashlight device according to the present invention.
Figure 2B:
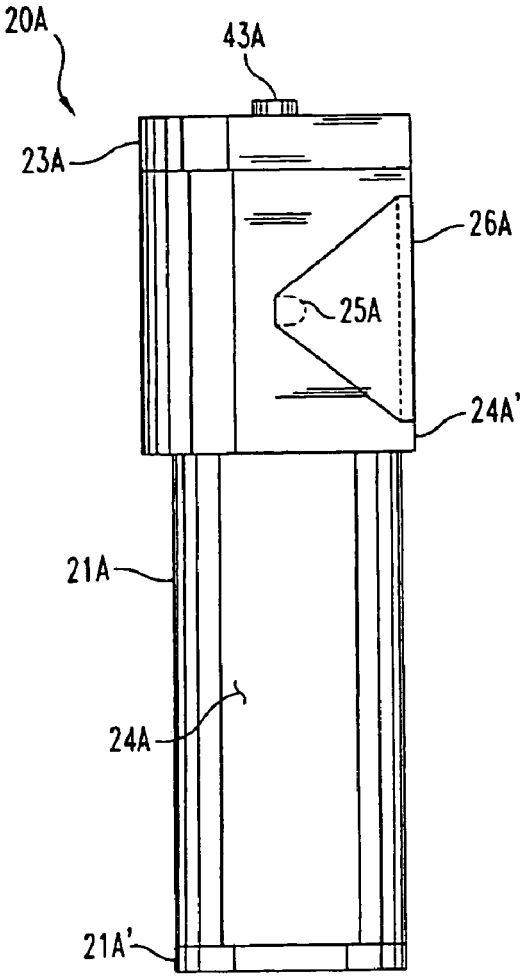
FIGS. 2B and 2C are right and left side views, respectively, of the flashlight device of FIG. 2A.
Figure 2C:
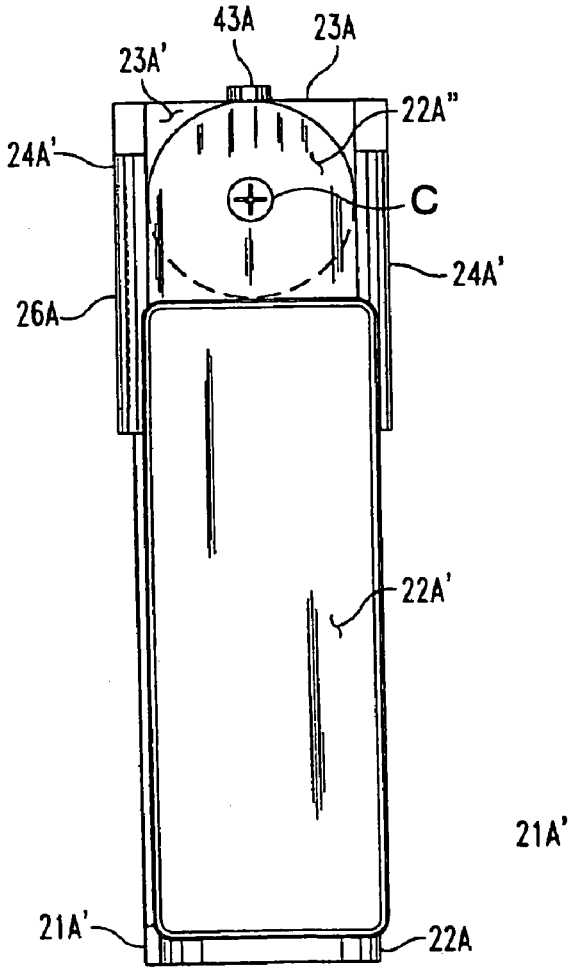

FIGS. 2A-2C illustrate a second embodiment of the flashlight device 20A of the present invention. Flashlight 20A is similar in many respects to flashlight 20 of FIG. 1, and has parts correspondingly numbered with the designator "A". Flashlight 20A, however, has a lightbox 21A that includes both a generally cylindrical portion 24A, and a flat front face portion 24A' in which lens 26A and light source 25A are mounted. As shown, face portion 24A' has a generally planar front, which extends into a generally rounded back portion. Flashlight 20A also includes a polymeric sleeve 22A' on its handle portion 22A, as well as a strap S to form a hand receiving opening 37A through which a user's hand may be placed. Strap S may be a loop of material received under sleeve 22A' as shown, or may be held to flashlight 20A by buckles or in any other suitable fashion. As well, strap S may also have connecting portions S1 and S2 as shown, which allow for adjustment of the size of the hand receiving opening 37A. This connection may be achieved, for example, by suitable hook and loop fasteners attached to and/or formed within the material of the strap S. Preferably, flashlight device 20A also incorporates a pivotable connection between handle portion 22A and linking member 23A. With reference to FIGS. 2A and 2C, linking member 23A includes a projecting leg 23A' with a generally "U" shaped external profile (lower periphery shown in phantom in FIG. 2C), and handle portion 22A includes a cooperating, generally semicircular internal profile and an extending leg 22A". These two legs 23A', 22A" provide opposing plates or faces that contact one another for a pivotable or rotatable, friction fit. The handle portion 22A is connected to linking member 23A by a connector 34A, such as a screw. The connection can be sufficiently tight to provide for a snug but pivotable relationship between the handle 22A and linking member 23A. Alternatively or in addition, the connector can be adjustable (e.g. as in a screw) so as to enable loosening the fit, adjusting the angle of handle 22A relative to linking member 23A, and then tightening the fit. Additionally, as discussed hereinabove in connection with FIG. 9, meshing gears, teeth, ridges or other surface features can be provided on the faces of legs 23A' and 22A", to facilitate a locked and/or fixed attachment between the faces.

Figure 2D:
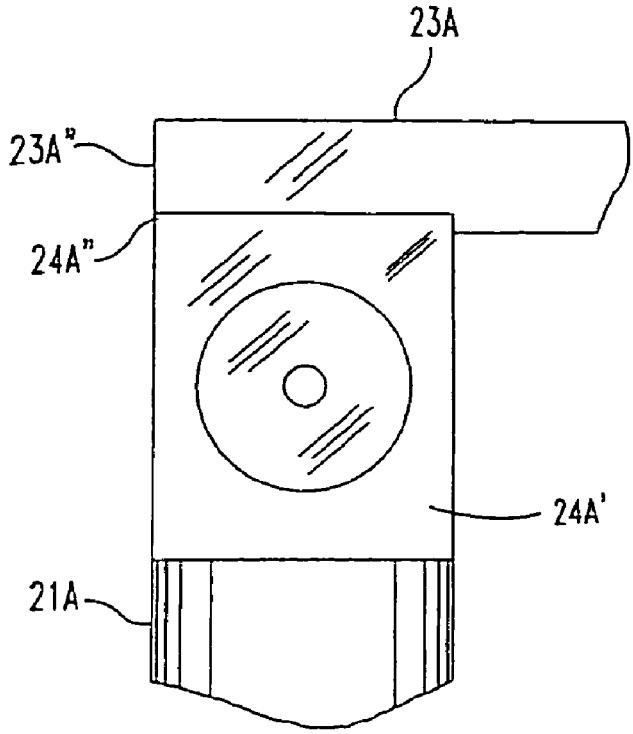
FIGS. 2D and 2E are front and right side views, respectively, of a portion of another embodiment of the flashlight device similar to the embodiment shown in FIGS. 2A-2C.
Figure 2E:
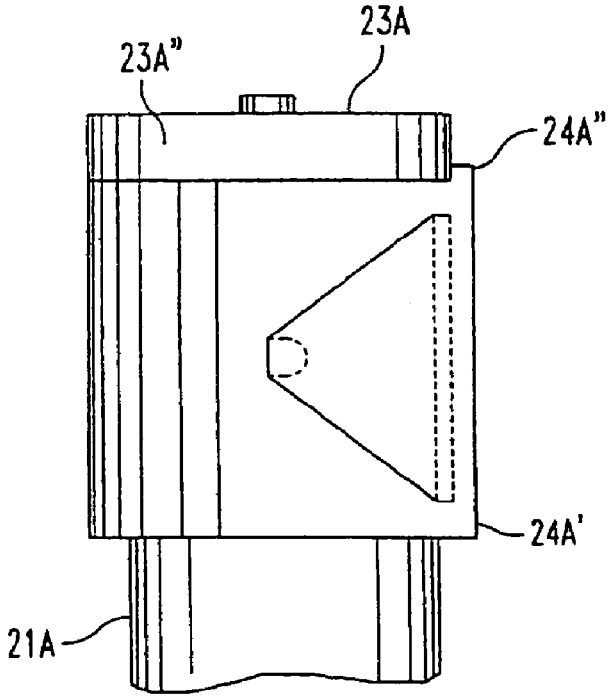

FIGS. 2D and 2E provide cutaway front and right side views corresponding to those of FIGS. 2A and 2B, except the flashlight device has a modified front face in which a lip 24A" or other projection extends upwardly from the face 24A', such that it overlies the front face of linking member 23A. As well, linking member 23A has a rounded end 23A". In this manner, the inward rotation of lightbox 21A is restricted by contact between lip 24A" and the front face of linking member 23A, but lightbox 21A can be freely rotated outwardly, and has about 180° of rotational freedom, so that the light can be positioned in the lighting position as shown in FIGS. 2D and 2E, the position reversed from that shown in FIGS. 2D and 2E to provide more effective use in either hand, as well as positions therebetween along the 180° of rotation (away from the handle portion).

Figure 4:
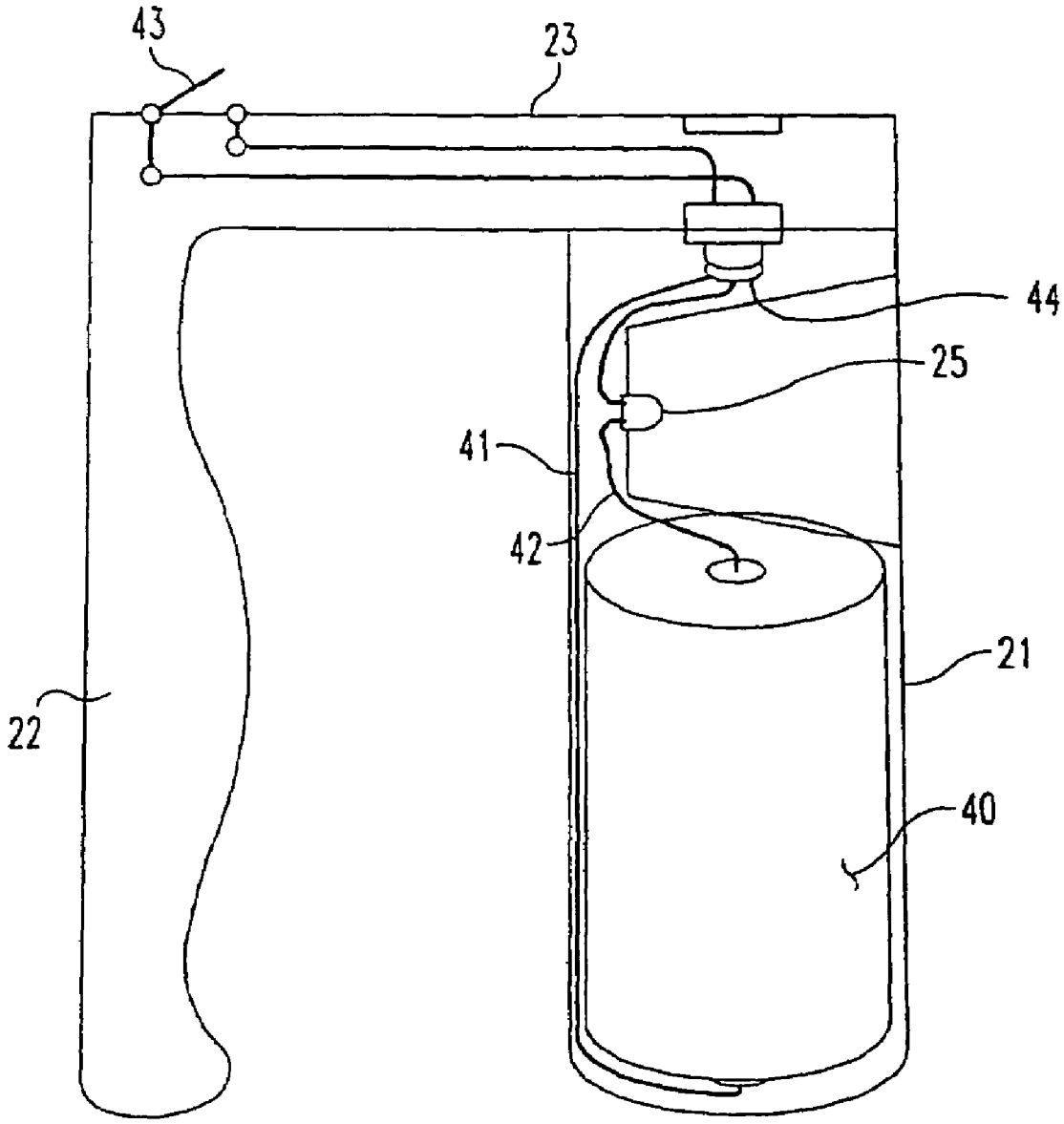
FIG. 4 is an illustration of the internal circuitry of a flashlight device according to an embodiment of the present invention.

With reference now to FIG. 4 together with FIGS. 1 and 2A-2E, provided is a drawing illustrating a potential configuration for the internal circuitry and electronics of the flashlight device 20, 20A. FIG. 4 will be described with reference to component reference numbers of flashlight device 20, although it is to be understood that the circuitry also applies to other embodiments of the invention. Preferably, light source 25 is positioned within lightbox 21 and is powered by one or more batteries 40 mounted within the lightbox 21. Access to the battery or batteries 40 can be provided, for example, via a threaded cap 21' (FIG. 1), 21A' (FIG. 2A) located at the bottom of lightbox 21 and 21A, respectively. Positive and negative leads 41 and 42 create a circuit in conjunction with light source 25 and switch 43 (FIGS. 1 and 4), 43A (FIG. 2A). For these purposes, leads 41 and 42 are positioned through a central channel 44 extending between lightbox 21 and linking member 23 as shown in FIG. 4. Preferably, switch 43, 43A is provided upon linking member 23, 23A and is spatially located atop or overlying handle portion 22, 22A or at a position along linking member 23, 23A between handle portion 22, 22A and lightbox 21, 21A. For instance, in one embodiment, switch 43, 43A can be provided adjacent or in proximity to the outer edge of the linking member 23, 23A overlying the outer edge of handle portion 22, 22A, to provide convenient access for operation during a two-handed firing position or other manual hand activities (see e.g. FIGS. 3 and 6). Switch 43, 43A can be of any suitable design for energizing and de-energizing the light source 25, 25A with the battery or batteries 40. Preferably, switch 43, 43A is a pressure-sensitive switch functional to energize the light source 25, 25A upon the exertion of pressure, but without locking or fixing the switch in the "on" position. In this fashion, the user of the flashlight can more readily briefly energize, and then de-energize the light source 25, 25A to fix the position of an article or person, but without continued illumination. In addition to a "pressure-on" position, such a pressure-sensitive switch may, if desired, have a fixed "on" condition that is achieved upon exerting greater than a predetermined level of pressure on the switch.

Figure 5:
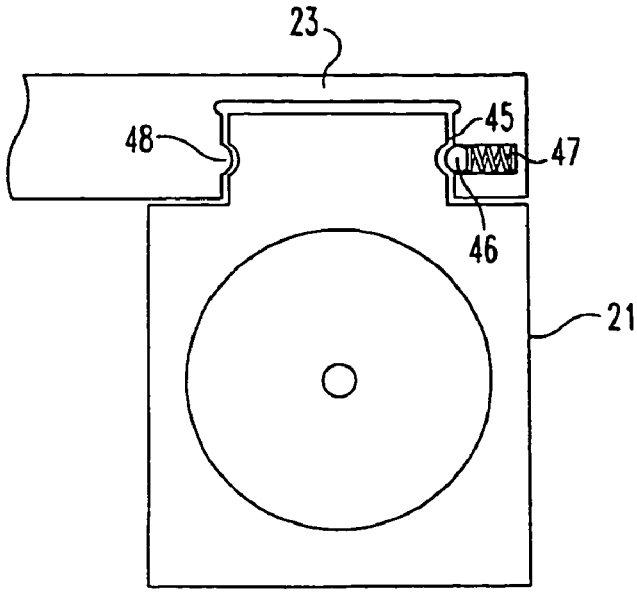
FIGS. 5 and 5A provide cutaway cross-sectional views of two potential rotatable connections between the linking member and lightbox of flashlights according to the present invention.

With reference now to FIG. 5 in conjunction with FIG. 1, shown is one potential embodiment of the invention for connecting the lightbox 21 to the linking member 23. In particular, in the illustrated arrangement a number of indexed or predetermined positions are defined between the lightbox 21 and the linking member 23. For example, cutouts or other depressions 45 may be provided within an outer side surface of the lightbox 21 at its upper end, and a cooperating member 46 such as a ball may be provided on the linking member 23 for cooperating with depressions 45 located around the circumference of lightbox 21. Cooperating member 46 can, for example, be biased toward the lightbox 21 with a spring 47 or other biasing device, to provide an appropriate level of resistance to hold lightbox 21 in a position defined by cutouts 45, but which resistance can be overcome with sufficient force to move the lightbox 21 to an alternate indexed position. Additional protuberances 48 can be provided around in the inner surface of the linking member connection to assist in the indexing function as well.

Figure 5A:
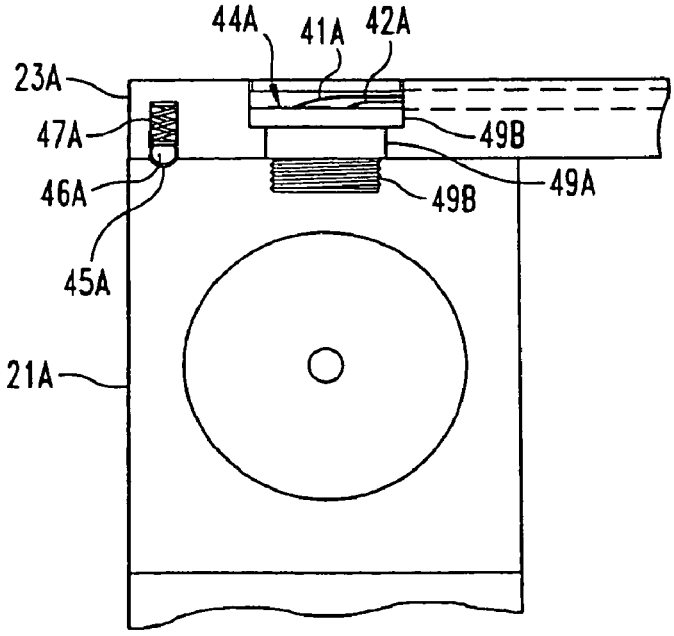

With reference now to FIG. 5A in conjunction with FIGS. 2A-2E, shown is an illustration of another manner of rotatably connecting lightbox 21A to the linking member 23A. In this embodiment, the ball 46A and spring 47A combination for the detent positions is received within an aperture in the lower surface of linking member 23A. Cutouts 45A or other indentations for cooperating with the ball 46A are then located upon an upper surface of lightbox 21A. Preferably, a hollow bushing 49A is received within a shouldered bore in linking member 23A, and a cooperating threaded member 49B is received through bushing 49A and threaded into a corresponding bore in the upper wall of lightbox 21A. A rotatable connection is thereby provided. As shown, threaded member 49B can be hollow or otherwise include a thru-bore 44A so that wires 41A and 42A can pass through the connection. Wires 41A and 42A can then, if desired, pass through an internal opening or bore within linking member 23A (FIG. 5A, shown in phantom) for connection to a switch as described hereinabove.

With reference generally to FIGS. 1, 2A-2E, 5 and 5A, any number of indexing positions for the lightbox 21, 21A can be provided. In one embodiment, lightbox 21, 21A will be restricted to 360° of rotation or less, for example 180° of rotation, having multiple defined indexed positions. Restricting rotation of the lightbox 21, 21A will assist in preventing undue twisting of leads 41, 42, 41A, 42A in the simple design illustrated, where the leads are fixed or otherwise tend to rotate along with the lightbox 21, 21A. Of course, other circuitry or wiring designs could be adopted to address this problem as well, including, for example, the use of a rotatable electrical connection. For example, use may be made of conductive metallic components such as metal disks or rings that provide electrical contact from the linking member and switch to the lightbox. The two components, one wired to the switch and one connected to the lightbox, would remain in constant contact with one another. The component wired to the switch would remain fixed while constantly making contact with the other component that would be connected to the lightbox. The component wired to the lightbox would rotate, for example, 180°. Another rotatable electrical design could incorporate a wired, spring-loaded pin which would make contact with a metallic component connected to the other of the lightbox or linking member.

Figure 3A:
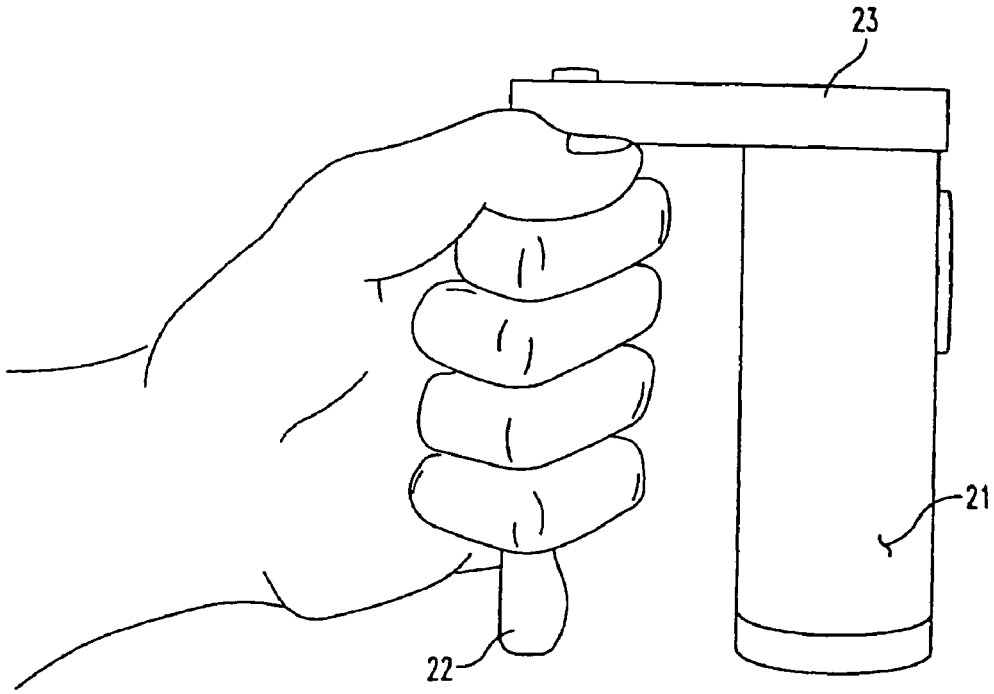
FIG. 3A is a perspective view of a flashlight device according to an embodiment of the present invention in a forward lighting position.

In a preferred design, lightbox 21, 21A will have indexed positions spaced about 90° from one another. With reference to the orientation of the devices 20, 20A as shown in FIGS. 1 and 2, these positions may be defined with the light source 25, 25A facing as shown (e.g. as used in a firearm firing position), 90° clockwise therefrom (thus facing directly away from handle 22, 22A for "forward lighting" (see FIG. 3A), and 180° clockwise from the illustrated position. This latter position allows the device 20, 20A to be similarly used in either the left or right hand during firing or other manual activities. More preferably, in addition to or as an alternative to these indexed positions, additional indexed positions may be provided within the range of rotation, including one or more indexed positions angled slightly less or slightly greater than 90° (see e.g. FIG. 6) to provide added versatility so that the direction of the light beam from light source 25, 25A is more directly aimed at a target during a firing position. The desired angle in this situation may vary depending upon the anticipated target distance, and upon the useful range of the light source 25, 25A. Also, it may be desirable to have "harder" detents at the 0°, 90° and 180° positions with "softer" detents at the other indexed positions.

Figure 10:
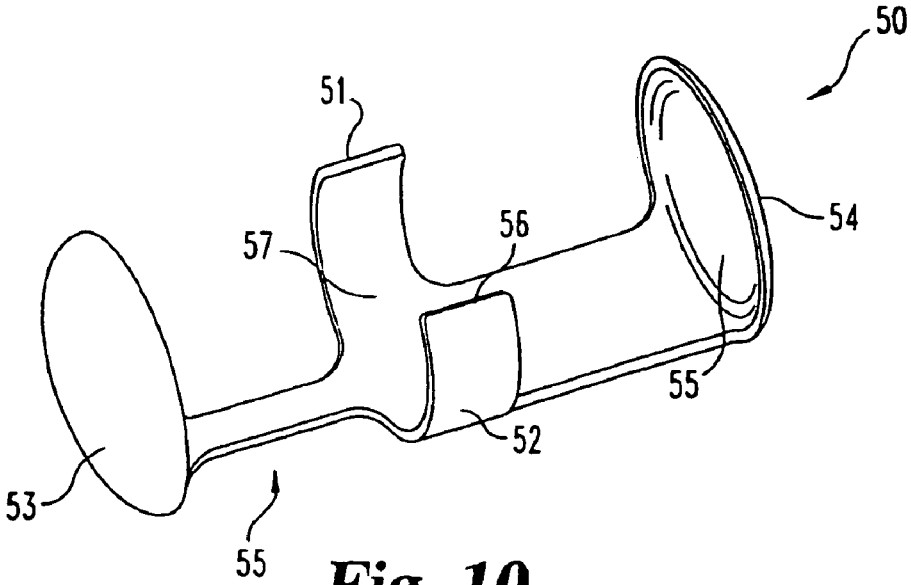
FIG. 10 is a perspective view of a flashlight holster device according to an embodiment of the present invention.
Figure 11:
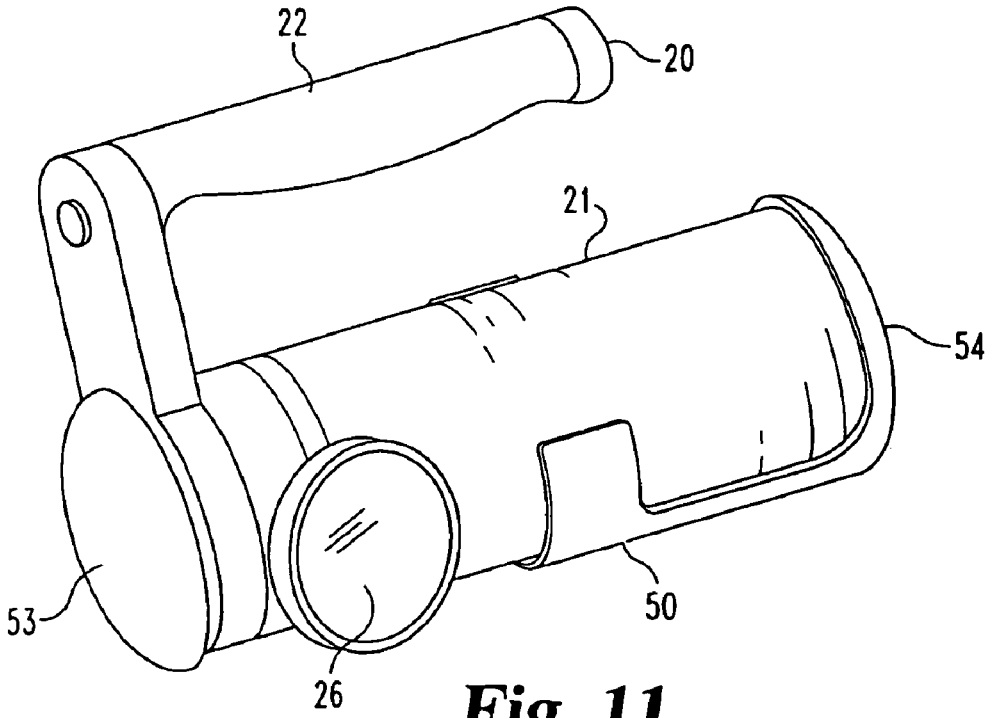
FIG. 11 is a perspective view of the holster device of FIG. 10 having a flashlight device mounted therein.
Figure 12:
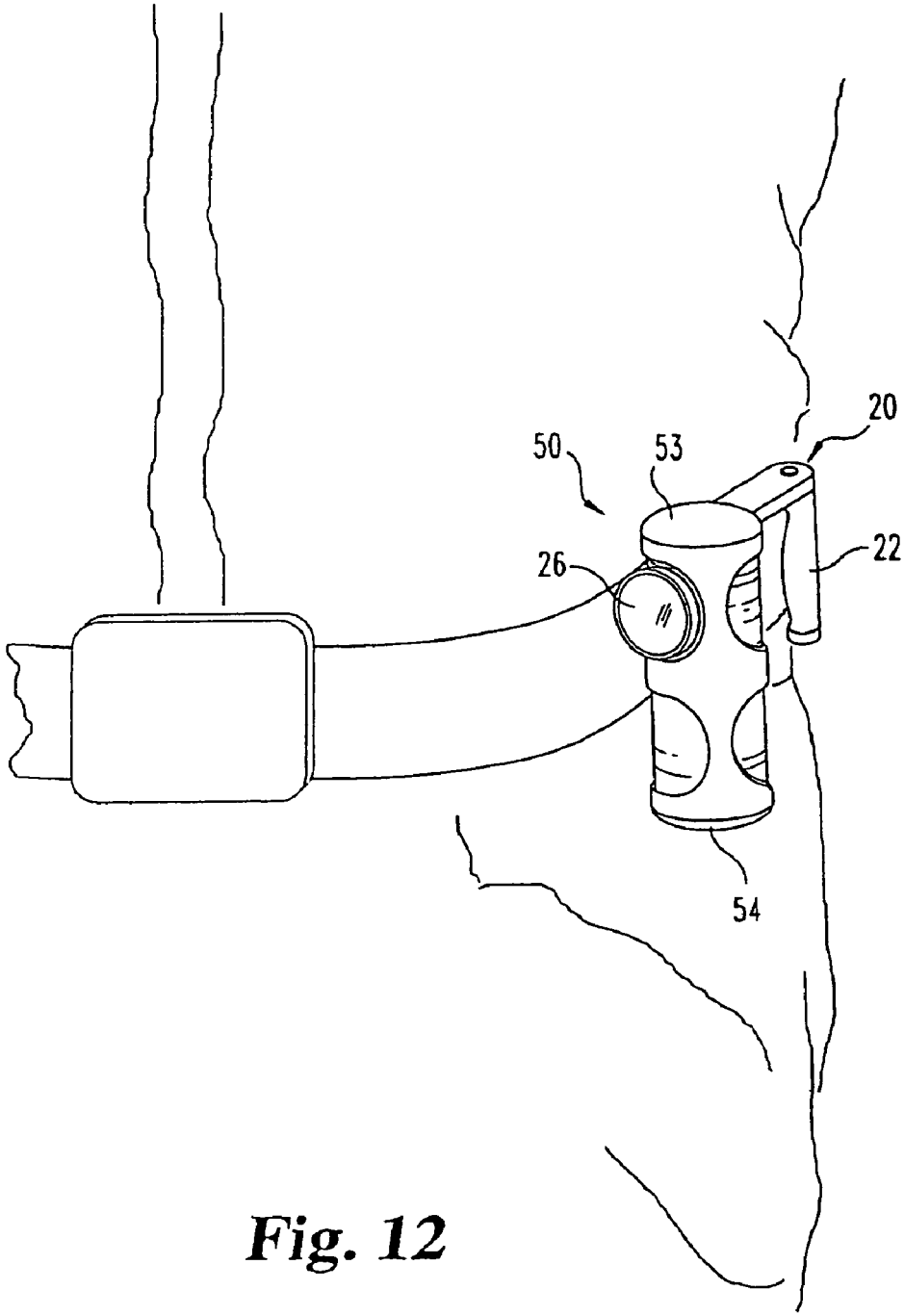
FIG. 12 is a perspective view of another embodiment of the holster device showing the flashlight/holster combination according to an embodiment of the present invention in use.

With reference now to FIGS. 10-12 in connection with FIGS. 1 and 2, illustrated is a holster 50 for use in connection with a flashlight 20, 20A of the invention. Holster 50 generally includes a member 51 for connection to the belt of a user, for example, by clipping on the belt or having the belt string through the member 51. Holster 50 also generally includes a receiving portion 52 for receiving the lightbox 21, 21A of the flashlight device 20, 20A. In particular, preferred holster device 50 includes a first end 53 and a second end 54, which serve to cover the lower surface of the lightbox 21, 21A and the linking member portion connected to the lightbox. The ends 53 and 54 also aid with alignment of the flashlight 20, 20A during a holstering function. Receiving portion 52 includes at least one cutout portion, and preferably a plurality of cutout portions along the body providing openings 55 for receiving the light source 25, 25A and lens 26, 26A of the lightbox 21, 21A, so that the flashlight 20, 20A may be used to provide illumination even when holstered (see e.g. FIGS. 11 and 12). Preferably, holster device 50 will include at least one member 56 located between ends 53 and 54 extending sufficiently up and potentially around lightbox 21, 21A to retain flashlight 20, 20A in holster 50 by gravitational force and/or by friction or snap fit.

With reference now particularly to FIG. 12, illustrated is the flashlight device 20, 20A contained within the holster 50, with lens 26, 26A of flashlight 20, 20A exposed for illumination in a forward direction. Holster 50 is secured to the side of a user, for example by attachment to a belt as discussed above. As shown in FIG. 12, the holster 50 has been rotated to a vertical orientation. This is provided in the preferred holster device by incorporating a swivel or other movable attachment between attachment member 51 and the receiving portion 52 of the holster device 50. Such a swivel function may, for example, be provided by a rotatable pin connector 57 connecting attachment member 51 and receiving portion 52 of holster device 50. As can be seen in FIGS. 11 and 12, when flashlight device 20, 20A is received within holster 50, handle portion 22, 22A is located external of receiving portion 52 of holster 50 and thereby readily available to grasp. In addition, the illustrated position can provide for "hands-free" forward illumination when the flashlight 20, 20A includes a fixed "on" switch position.

Housing components of devices of the invention are preferably made from metal or an impact-resistant plastic, such as ABS. In addition, flashlights according to the present invention are desirably constructed to be waterproof, for example, by incorporating O-rings between moving parts, and plastic parts are preferably made fire retardant either in their composition, or with a suitable fire retardant coating. Flashlights according to the present invention also desirably incorporate attachable or attached red lenses adapted to cover the light source 25, 25A. Such red lenses facilitate dimming the light source, and in combat or defense situations make it more difficult for a target to discern people or things behind the light source.

Figure 13:
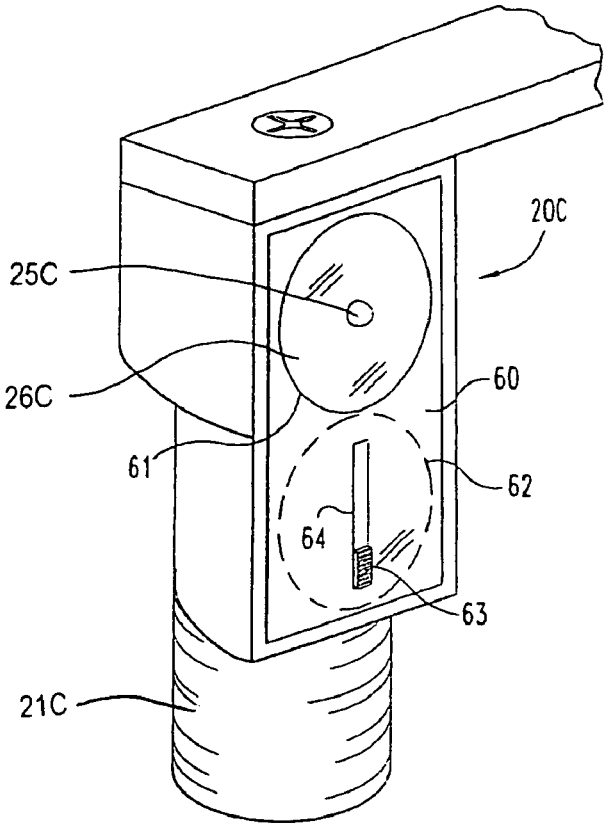
FIG. 13 is a cutaway perspective view illustrating a lightbox of another embodiment of the flashlight device of the present invention, including a slidable red lens.

With reference now to FIGS. 13 through 19, a number of illustrative red lens appliances useful in conjunction with flashlights 20 and 20A, or modified versions thereof, are shown. Shown in FIG. 13 is a partial cutaway view of such a flashlight 20C, including a lightbox 21C with an extended, front flat panel incorporating a slidable red lens that can be selectively positioned over the primary clear lens 26C. In particular, an external panel 60 fixed to the lightbox 21C defines an internal cavity and has a cutout 61 sufficient to expose lens 26C. A red lens 62 (shown in phantom) is slidably received within the defined cavity, and has an attached manual slider member 63 protruding through a slot 64 in the panel 60. In this fashion, a user can manually (e.g. with a finger) slide the red lens 62 overtop of and off of the light source 25C as desired in a particular situation. The position of the red lens 62 within the cavity can be maintained for example by a relatively light friction fit within the cavity, or by other mechanisms by which elements of or attached to the lens 62 cooperate with surrounding surfaces. Additionally, red lens 62 can be sized to have dimensions larger than those of cutout 61 so that lens 62 does not escape or get caught up in cutout 61. Internal channels may also be provided within the defined cavity, in which the outer edges of lens 62 travel. As well, instead of cutout 61, panel 60 may include a transparent lens mounted therein to serve in addition to or as an alternative to any other transparent lens of the flashlight 20C.

Figure 14:
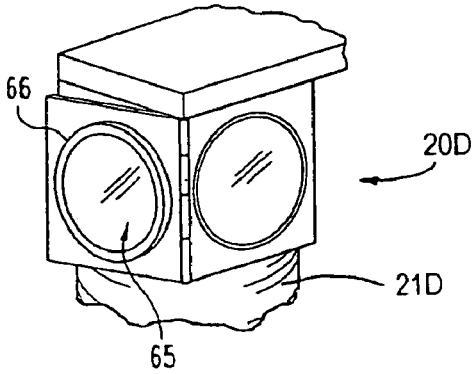
FIG. 14 is a cutaway perspective view illustrating a lightbox of another embodiment of the flashlight device of the present invention, including a hinged red lens.

FIG. 14 provides a cutaway perspective view of another flashlight embodiment 20D of the invention including a red lens 65 received within a frame 66 hinged to the lightbox 21D.

Figure 15:
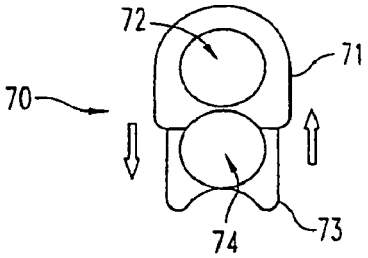
FIG. 15 is a front view of a red lens appliance according to an embodiment of the present invention.

FIG. 15 provides an appliance 70 in which a red lens is incorporated in a slidable fashion. Appliance 70 includes a first member 71 having a slot therein and an opening 72, and a second member 73 slidably received in the slot. Second member 73 includes a red lens 74, wherein sliding second member 73 into first member 71 exposes the red lens 74 in the opening 72. An appliance such as appliance 70 can be built into, fixedly attached or removably attached (e.g. using a clinging mechanism similar to that shown in FIGS. 16-18 below) to a flashlight device such as 20 or 20A (FIGS. 1 and 2) with the opening 72 positioned over lens 26 or 26A. Selective use of the red lens 74 is thereby enabled.

Figure 17:
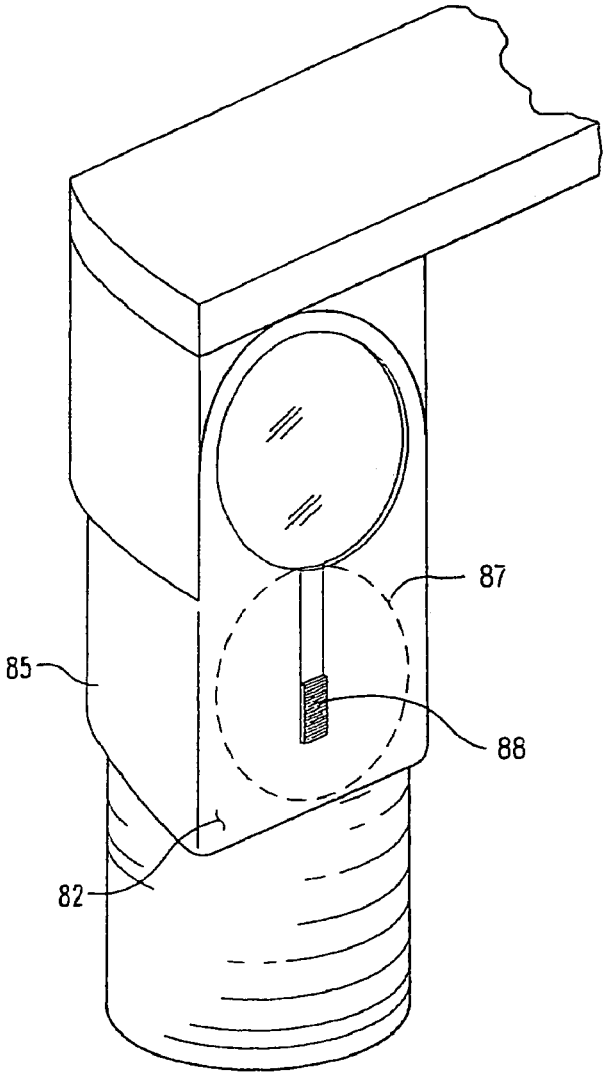
FIG. 17 is a cutaway perspective front and side view of the red lens appliance of FIG. 16 connected to a flashlight lightbox.
Figure 16:
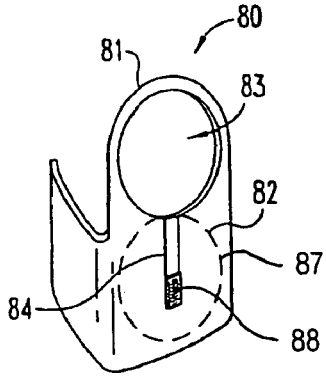
FIG. 16 is a perspective view of another embodiment of the red lens appliance of the present invention.
Figure 18:
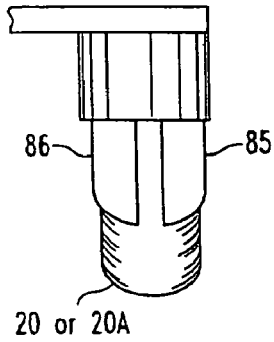
FIG. 18 is a cutaway perspective back view of the appliance of FIG. 16 connected to a flashlight lightbox.

FIGS. 16-18 illustrate another red lens appliance 80 of and for use in the invention. Appliance 80 has a body 81 including a double-walled front panel 82. Panel 82 defines a slot between its two walls for slidably receiving a red lens 87 (shown partially in phantom). Panel 82 also defines a lens opening 83 and an elongate slot 84. A manual slider member 88 attached to the red lens 87 is exposed through the elongate slot 84, for manual operation to selectively position the red lens 87 into and out of the lens opening 83. Body 81 also includes deformable members 85 and 86 which can be deformed so as to provide a mechanical fit such as a snap or friction fit around a cylindrical or other correspondingly configured portion of a lightbox such as 20 or 20A (see also FIGS. 1 and 2). In this fashion a user can both selectively connect and disconnect the appliance 80 with the flashlight, and selectively use or not use the red lens 87 when the appliance 80 is connected.

Figure 19:
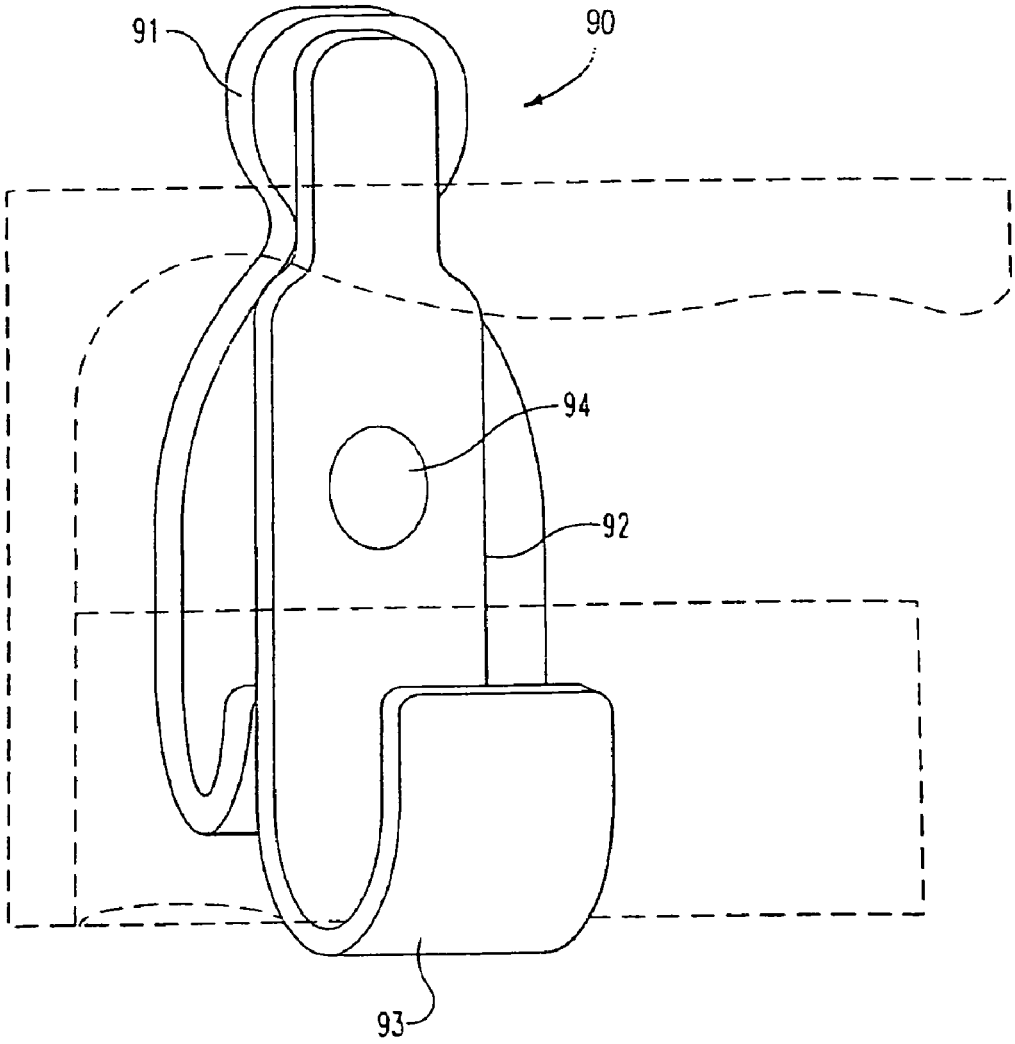
FIG. 19 is a perspective view of another flashlight holster according to the present invention with the phantom lines illustrating a flashlight device.

With reference to FIG. 19, shown is another holster appliance 90 of and for use in the present invention. Appliance 90 includes a clip portion 91 for attachment to a belt or other similar structure of a user, that is attached to a body 92 adapted for providing a mechanical fit such as a snap or friction fit around a cylindrical or other correspondingly configured portion of a lightbox such as 20, 20A (see also FIGS. 1 and 2). Body 92 thus can include at least one deformable member 93 configured to fit around and cling to a lightbox such as 20, 20A. Desirably, body 92 can be designed so as not to cover or block the lens and light source of such lightboxes, so that the flashlight can be effectively used for illumination while worn attached to the belt of a user. As well, the attachment of body 92 to clip portion 91 can be via a rotatable connection, such as at 94, so as to provide flexibility in use.

Figure 20:
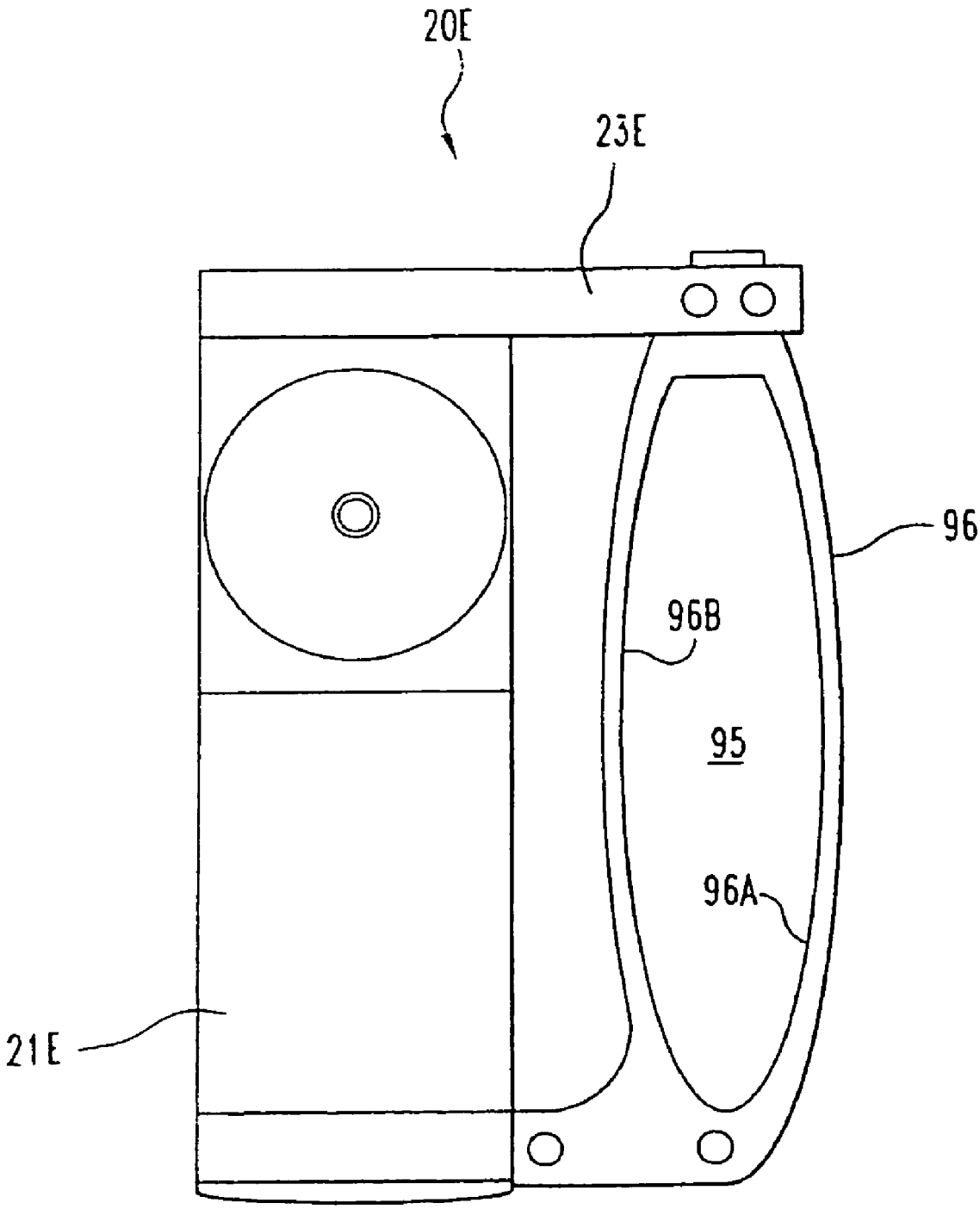
FIG. 20 is a front elevation view of another embodiment of flashlight device according to the present invention, including a strap assembly handle.

With reference to FIG. 20, illustrated is another flashlight embodiment 20E according to the present invention. Flashlight 20E can include features generally corresponding to those of the lightboxes and linking members described for other embodiments hereinabove. However, a different type of handle is provided. In particular, the handle is provided by a strap assembly 96 including first and second strap members 96A and 96B forming an enclosed loop 95 to receive a user's hand. Strap assembly 96 is connected at its upper end to the linking member 23E and at its lower end to the lower portion of the lightbox 21E. The connection to lightbox 21E is preferably such that the lightbox 21E still can rotate. This may be achieved, for example, by incorporating a ring into the structure of lightbox 21E that is rotatable relative to the remainder of the lightbox 21E (for example, a ring captured within a groove defined between a battery cap and a shoulder of the lightbox housing), or by providing a ring received around lightbox 21E to which the strap assembly 96 is attached.

Figure 21:
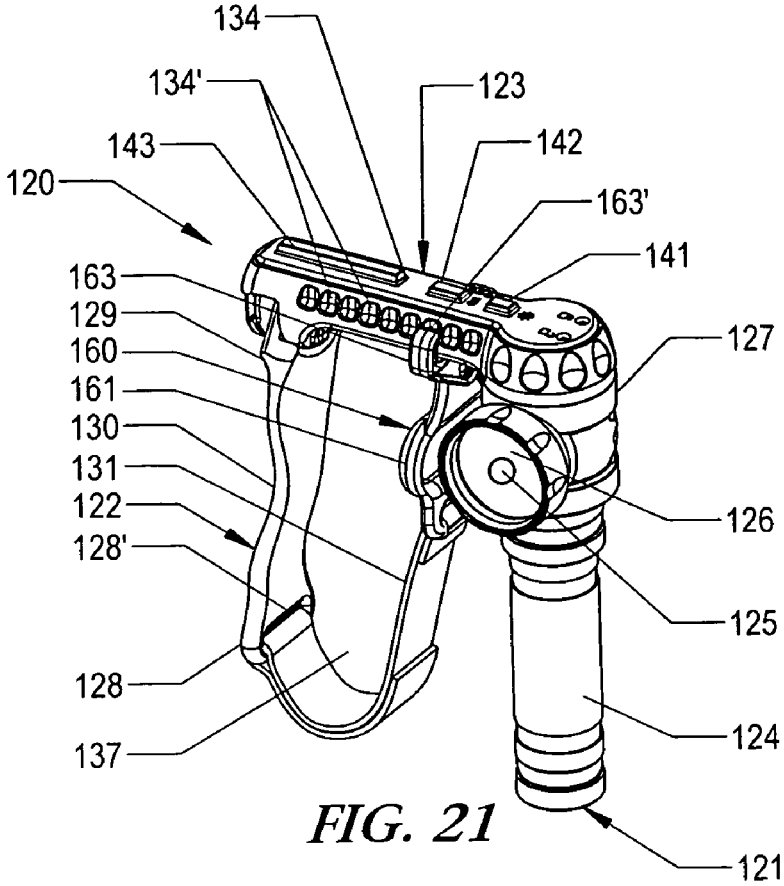
FIGS. 21 and 22 are perspective views of another preferred embodiment of the flashlight device according to the present invention.

Referring to FIGS. 21-27, a flashlight device 120 according to another embodiment of the present invention will now be described. Flashlight device 120 includes a lightbox assembly 121, a handle assembly 122, and a linking member assembly 123 connecting the lightbox assembly 121 and handle assembly 122. Preferably, lightbox assembly 121 includes a generally cylindrical body 124 having mounted therein a light source 125 situated behind a lens 126, preferably formed with a relatively shatter-proof plastic material. A first end 127 of the lightbox assembly 121 is preferably rotatably connected to the linking member assembly 123. The connection between the lightbox assembly 121 and the linking member assembly 123 may be accomplished by one of the aforementioned techniques or by other similar techniques known to persons of skill in the art. Although this connection could be integral, it is preferred that the connection be a movable connection, for example providing for angular rotation about a longitudinal axis of the lightbox assembly 121 so that a user of the flashlight 120 can adjust the direction of the light beam emanating from the light source 125. In the flashlight device 120 as illustrated in FIG. 21, the light source 125 emanates a light beam in a direction generally transverse to the longitudinal axis of the lightbox assembly 121.

Preferably, the handle assembly 122 is likewise movably connected at a handle first end 129 to the linking member assembly 123 by one of the aforementioned techniques or by other similar techniques known to persons of skill in the art. The linking member assembly 123 includes a linking member 134 having a longitudinal axis. The handle assembly 122 is generally transverse to the longitudinal axis of the linking member 134 and generally pivots about such longitudinal axis.

Figure 23:
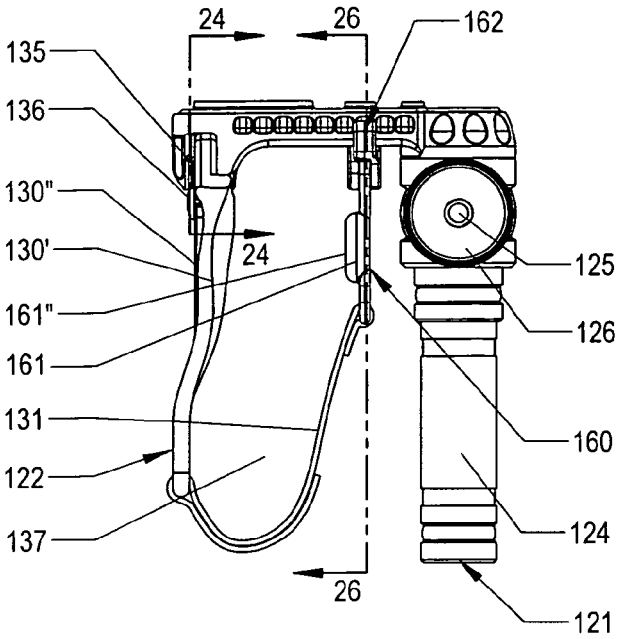
FIG. 23 is a front elevation view of the flashlight device embodiment shown in FIGS. 21 and 22.
Figure 24:
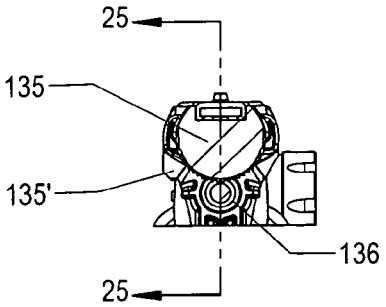
FIG. 24 is a view taken along lines 24-24 of FIG. 23.
Figure 25:
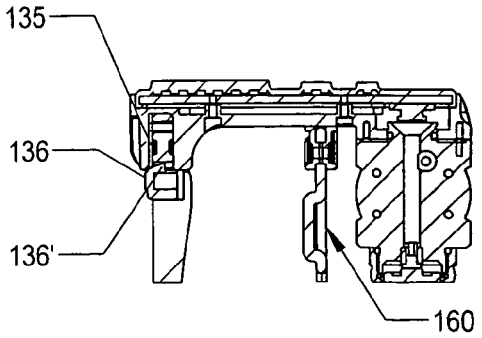
FIG. 25 is a view taken along lines 25-25 of FIG. 24.

A preferred movable connection between the handle assembly 122 and the linking member assembly 123 is shown in FIGS. 23-25. An indexer gear 135 having a plurality of teeth 135' is secured to the linking member 134. Preferably, the indexer gear 135 is not allowed to move relative to the linking member 134. The first or upper end 129 of the handle assembly 122 is pivotally connected to the linking member 134. The handle assembly 122 includes a button 136, preferably a spring-biased push button (spring not shown), having gear teeth 136'. As shown in FIG. 25, the gear teeth 136' are preferably angled from front to back so that they disengage when the button 136 is depressed and re-engage when the button 136 is allowed to spring back.

Figure 27:
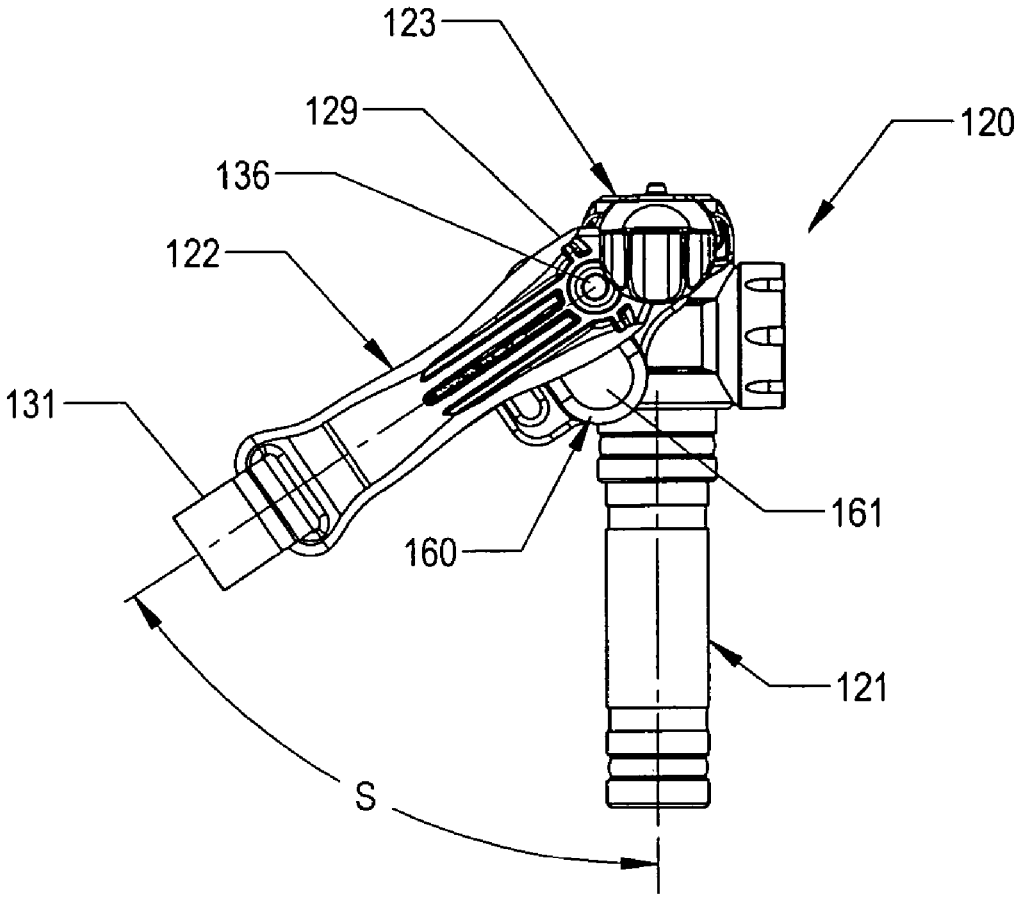
FIG. 27 is a side view of the flashlight device of FIGS. 21-23 showing the handle in a pivoted position.

To adjust the angle of the handle assembly 122 relative to the lightbox assembly 121, the user pushes the spring-loaded button 136 which disengages the teeth 136' on the button 136 from the indexing gear teeth 135' and the handle assembly 122 is pivoted to the desired position. Once in the desired position the push button 136 is released and the teeth 135' and 136' re-engage. This design allows the user to adjust the "sweep" S of the handle 122 as shown in FIG. 27 without tools. Additionally, the user can activate the spring-loaded button 136 with the index finger of the hand that is in the hand receiving opening 137 (FIGS. 21-23) of the flashlight device 120 and grasp the lightbox assembly 121 with the opposite hand to adjust the handle sweep. In the preferred embodiment, the sweep S is in the range of 50° to 60° to either side of the axis of the lightbox assembly 121. Sweeping to both sides allows full use by both left- and right-handed users.

Figure 22:
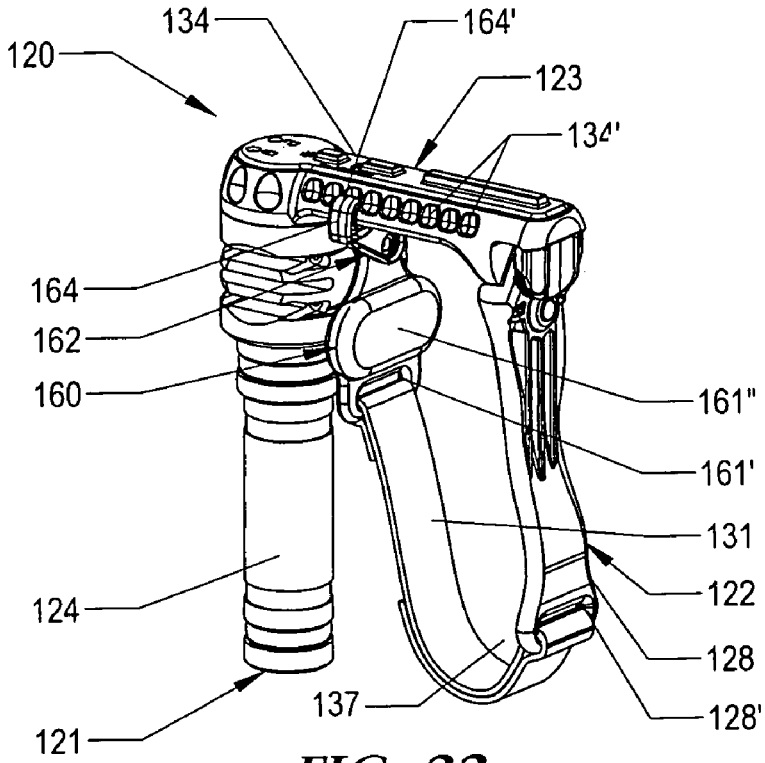

The handle assembly 122 also includes a second end 128 and a central portion 130 spanning between the first and second ends 129 and 128, respectively. Preferably, central portion 130 is ergonomically contoured, as for example with one or more convex or concave sections. In the preferred embodiment as illustrated in FIGS. 21-23, central portion 130 includes an inwardly-facing (toward the lightbox assembly 121) convex portion 130' adapted to ergonomically cooperate with the palm of the hand in a firing position of a handgun (see FIG. 23). Additionally, the central portion 130 preferably includes an outwardly-facing (away from the lightbox assembly 121) generally concave portion 130" adapted to provide a clearance between the central portion 130 of the handle assembly 122 and the firearm when held in the two-handed firing position. The concave portion 130" provides a clearance so that the handle assembly 122 does not accidentally come into contact with a firearm's magazine release button located on an automatic firearm's side opposite the firing hand. If desired, handle assembly 122 can be covered with or made of a material with a relatively high coefficient of friction to improve gripping properties.

Figure 26:
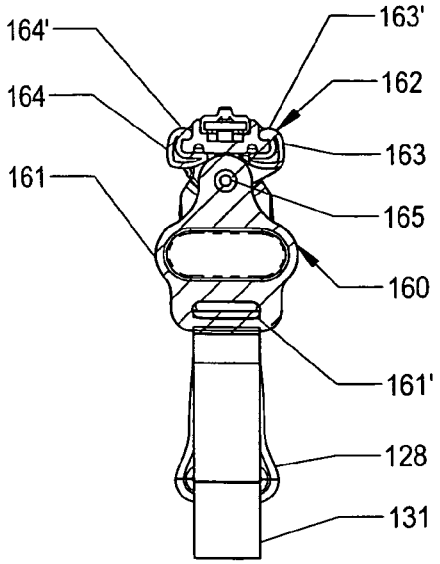
FIG. 26 is a view taken along lines 26-26 of FIG. 23.

Preferably, the second end 128 of the handle assembly 122 is adapted to attach a strap 131 thereto with the strap 131 extending toward the linking member assembly 123. In the illustrated embodiment, a slot 128' is provided in the second end 128 of the handle assembly 122 for securing the strap 131 to the handle assembly 122. Preferably, the strap 131 is also secured to a hand stabilizer assembly 160 connected to the linking member assembly 123 to define a hand receiving opening 137. Referring to FIGS. 21-23 and 26, the hand stabilizer assembly 160 preferably includes a hand pad 161 connected to the linking member 134 via a clip assembly 162. The strap 131 is attached to the hand pad 161, preferably via a slot 161'. The clip assembly 162 preferably includes first and second hook members 163 and 164, respectively, connected to each other via a fastener 165, such as a pin or rivet 165 (FIG. 26). The hand pad 161 is preferably pivotally connected to the clip assembly 162. In the preferred embodiment, the hand pad 161 is pivotally connected to the clip assembly 162 via the pin 165 and the strap 131 is connected to the hand pad 161 via a slot 161A. The pin 165 allows the hand pad 161 to swivel independently from the clip assembly 162. Thus, as the handle assembly 122 is pivoted relative to the linking member assembly 123, the strap 131 "pulls" on the hand pad 161 to similarly pivot the hand pad 161 as shown in FIG. 27. This feature of maintaining the hand pad 161 substantially in line with the strap 131 and handle assembly 122 maintains the maximum amount of surface area of the strap 131 contacting the user's hand during use regardless of the pivoted position of the handle assembly 122. Preferably, the strap 131 is adjustable in length to accommodate various sizes of hands.

Referring to FIGS. 22 and 23, a plurality of recesses 134' are formed in the linking member 134. The recesses 134' are preferably uniformly spaced along a portion of the length of the linking member 134 and in pairs positioned on opposite sides of the linking member 134. Each recess 134' is adapted to receive an end portion 163' and 164' of the hook members 163 and 164, respectively. The hand pad 161 includes a surface 161" facing the handle assembly 122 adapted to contact the back of the user's hand. Preferably, during one operation of use the palm of the user's hand is against the inside surface or convex portion 130' of the handle assembly 122 and the back of the hand is against the hand pad surface 161". Preferably, the user's hand is snugly received in the hand receiving opening 137 between the handle assembly 122 and the hand pad 161 to stabilize the flashlight 120 on the hand without the necessity of grasping the handle assembly 122 or other portion of the flashlight 120. The desired spacing between the hand pad surface 161" and the opposing surface of the handle assembly 122 is achieved by placing the hook end portions 163' and 164' in the appropriate recesses 134' for the desired spacing.

Preferably, the spacing between the handle assembly 122 and the hand pad 161 is easily adjustable without the need for tools. In the illustrated embodiment, the location of the hand pad 161 can be adjusted by disengaging the hook end portions 163' and 164' from the recesses 134' and re-engaging the hook end portions 163' and 164' in the desired recesses 134'. Depending on the type of material that the clip assembly 162 is made out of, the hook end portions 163' and 164' may be forcibly disengaged and re-engaged in the recesses 134'. Alternatively, the clip assembly 162 could be made such that the hook end portions 163' and 164' can be disengaged from a pair of recesses 134' by moving the pin connection of the clip assembly 162 towards the linking member 134 to slightly raise and spread the hook end portions 163' and 164' out of engagement with the pair of recesses 134', thus permitting sufficient clearance to slide the clip assembly 162 along the linking member 134 to the desired pair of recesses 134'.

The preferred construction of the hand stabilizer assembly 160 allows the hook members 163, 164 to increase the gripping force exerted on the linking member 134 when downward or pulling pressure is applied to the hand pad 161, as for example by tightening the strap 131. In addition, the stabilizer assembly 160 rigidifies the strap 131 itself to eliminate the tendency for the flashlight 120 to inadvertently move or slip on the user's hand when the hand is opened and moved in an abrupt way.

Preferably, the strap 131 is connected at one end to the hand pad 161 and at the other end to the handle slot 128', which allows the strap 131 to be doubled back and secured to itself using a hook and loop fastener, for example a Velcro fastener. The combination of the handle assembly 122, the linking member 134, the hand stabilizer assembly 160 and the strap 131 define the hand receiving opening 137 through which the user's hand can be placed while using the flashlight 120. Preferably, the strap 131 can be disconnected from the hand pad 161 and from the handle slot 128' to remove it from the flashlight device 120. If desired, the hand stabilizer assembly 160 can be removed from the device 120. For example, removal of the hand stabilizer assembly 160 can be accomplished by forcibly prying the hook members 163 and 164 from the linking member 134. This enables the user to operate the flashlight 120 with a large glove that would require more room for the hand than the hand stabilizer assembly 160 allows. Other users may prefer not to "fix" the flashlight 120 to the hand and this removal option allows for this as well.

In the preferred embodiment of the present invention as shown in FIGS. 21 and 22, the flashlight device 120 includes one or more switches for controlling various lighting features. With reference to FIG. 21, a power switch 141, an on/off switch 142 and a momentary "on" switch 143 are preferably located on the linking member 134. Preferably, the momentary "on" switch 143 is an elongated switch located adjacent or in proximity to the outer edge of the linking member 123 overlying the outer edge of handle assembly 122 to provide convenient access for operation during various firing positions, including a two-handed combat position and positions used in firing long guns as described below, or other manual hand activities. Preferably, switch 143 is a pressure-sensitive switch functional to energize the light source 125 upon the exertion of pressure, but without locking or fixing the switch in the "on" position. In this fashion, the user of the flashlight device 120 can more readily briefly energize, and then de-energize the light source 125 to fix the position of an article or person, but without continued illumination.

On/off switch 142 is preferably a switch having a fixed "on" condition that is achieved by exerting a predetermined level of pressure on the switch 142. In the "on" condition, the light source 125 is constantly illuminated until the switch 142 is again depressed to change the switch to the "off" condition.

Preferably, the power switch 141 is a multi-stage switch to adjust lamp brightness. For example, the power switch 141 may be a three-way switch to provide three levels of lamp brightness.

Preferably, a "lockout" is provided to ensure that the on/off switch 142 or the momentary "on" switch 143 are not inadvertently "on" while the flashlight device 120 is stored such that the batteries are dead when the flashlight device 120 is needed by the user. In an embodiment of the present invention, the lockout is activated by simultaneously depressing the power switch 141 and the constant on/off switch 142 and may be released in a similar manner. In the lockout condition, the light source 125 cannot be powered by either of the switches 142 and 143 being pressed to their "on" condition. This ensures that the flashlight device 120 is not inadvertently on while stored and is ready for use when needed by the user.

Long-gun Application

Currently law enforcement and military personnel use gun-mounted flashlights for use on long guns, such as rifles and shotguns, in tactical environments. These flashlights are often attached to a ring retainer that is then attached to a Picatinny rail mount system on the long gun itself. Some of these lights are fixed with screws, others are attached to the rail using "quick release" mechanisms, while other lights are attached using a ring retainer that is attached to the barrel of the weapon. Many of these lights are regular flashlights with a "pigtail" switch in an optional tailcap, which replaces the stock tailcap.

Figure 28:
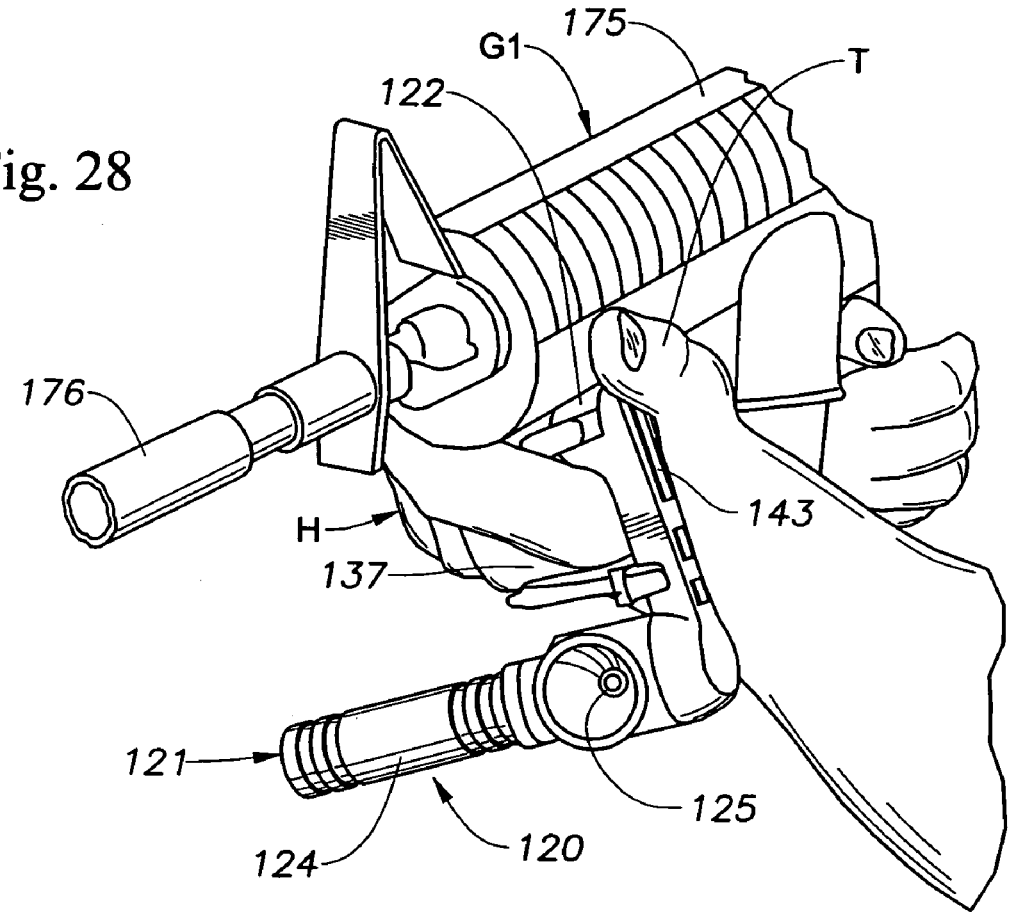
FIG. 28 is a perspective view of the flashlight device of FIG. 27 being used with a first long gun.
Figure 29:
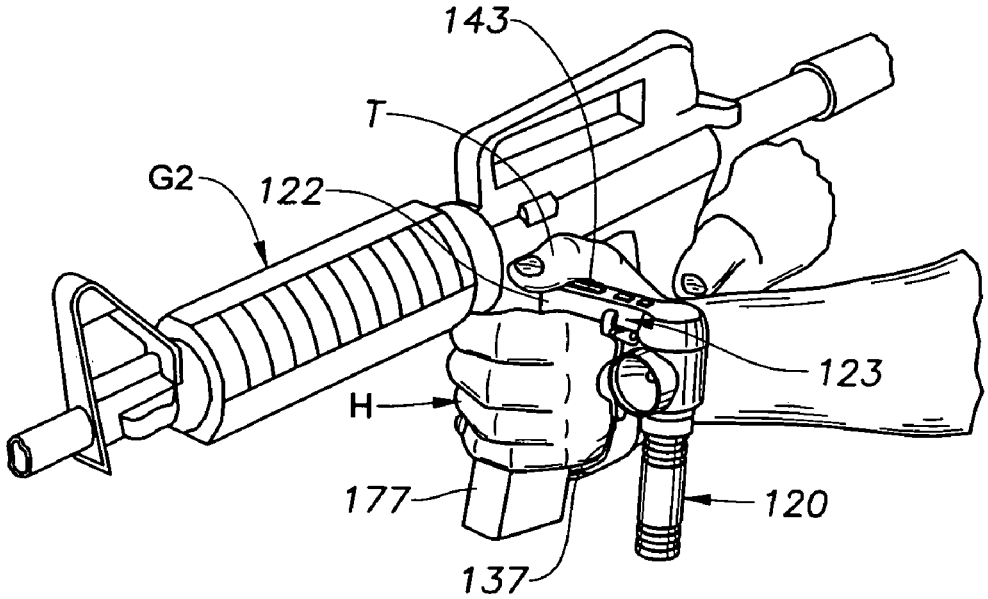
FIG. 29 is a perspective view of the flashlight device of FIGS. 21-23 being used with a second long gun.

Although the present invention has been described above for use in a tactical position with a handgun, the various embodiments of the flashlight device according to the present invention can also be used with long guns, including rifles and shotguns. The following description will be with respect to the flashlight device 120 although it is to be understood that the other embodiments are also adapted for such use. FIGS. 28 and 29 show the flashlight device 120 being used in two positions with long guns G1 and G2, respectively.

In FIG. 28, the long gun G1 is held by grasping the "horizontal" forearm 175 of the long gun G1. Preferably, the user sweeps the handle 122 (see FIG. 27) to a position such that when the forearm 175 of the weapon is grasped in the typical manner, the light source 125 is substantially in-line with the barrel 176 of the gun G1. With the user's non-shooting hand H in the hand receiving opening 137, the user grasps the "horizontal" forearm 175 of the weapon G1 as shown in FIG. 28. In this method the forearm 175 of the weapon G1 preferably "rests" on or contacts the handle 122 of the flashlight device 120 and the switch 143 is readily accessible by the thumb T of the non-shooting hand H to emit a light beam toward the target. Typically, the handle 122 is not swept to a position perpendicular to the light housing 124 as one might assume, but rather is swept to a position that allows it to fit comfortably into the palm of the hand H when the forearm 175 of the weapon G1 is grasped.

In addition to the user being able to position the flashlight device 120 to shine forward while grasping the standard "horizontal" forearm 175 of the long gun G1, the flashlight device 120 can also be used when grasping either a "vertical" forearm or an ammunition magazine 177 of the long gun G2, as shown in FIG. 29. A vertical forearm 177 is often added as an accessory to the long gun weapon G2. It is to be understood that the flashlight device of the present invention can be used with either a vertical forearm or ammunition magazine. Referring to FIG. 29, with the user's non-shooting hand H in the hand receiving opening 137, the user grasps the ammunition magazine 177 with the handle 122 resting against the magazine 177. Preferably, the user wraps all fingers around the vertical magazine 177 except for the thumb T which is positioned above the linking member assembly 123 to activate the switches, typically the momentary switch 143.

Oftentimes when conducting a building search, users will transition from a rifle to a handgun depending on the situation. The flashlight device of the present invention allows the user great flexibility when transitioning between weapons. Since the flashlight device attaches to the hand and not to the gun, no removal of the flashlight device from the gun is required. Furthermore, since the flashlight neither attaches to the gun or requires any modifications to the gun, the first gun can be quickly holstered in its typical manner and the second gun immediately picked up.

The flashlight device of the present invention is extremely versatile and quickly and easily transitions between the tactical position (lightbox assembly 121 opposite the palm, behind the hand) when using a handgun and the tactical position used with the long guns—whether grasping the long gun horizontally or vertically—and vice versa. Depending on the guns and the user, it may be necessary or desirable to adjust the "sweep" or angle of the handle 122 relative to the lightbox assembly 121. This is done quickly by pushing in the button 136 and pivoting the handle 122 to the desired angle—without the use of any tools. Typically, the direction of the light source 125 relative to the linking member 123 remains unchanged and requires no adjustment. Even if adjustment is required, it is very quickly and easily accomplished.

Additional benefits not to be overlooked are that the flashlight device does not require any mounting or attachment devices to be added to the gun(s). As a result, the guns can be holstered in their typical manner. Also, by having the flashlight device independent from (not mounted or attached to) the weapon, it allows the user to illuminate in directions independent of the direction the weapon is being pointed—an added safety feature when illuminating human subjects.

Better Shooting in any Lightbox Assembly Position

Figure 30:
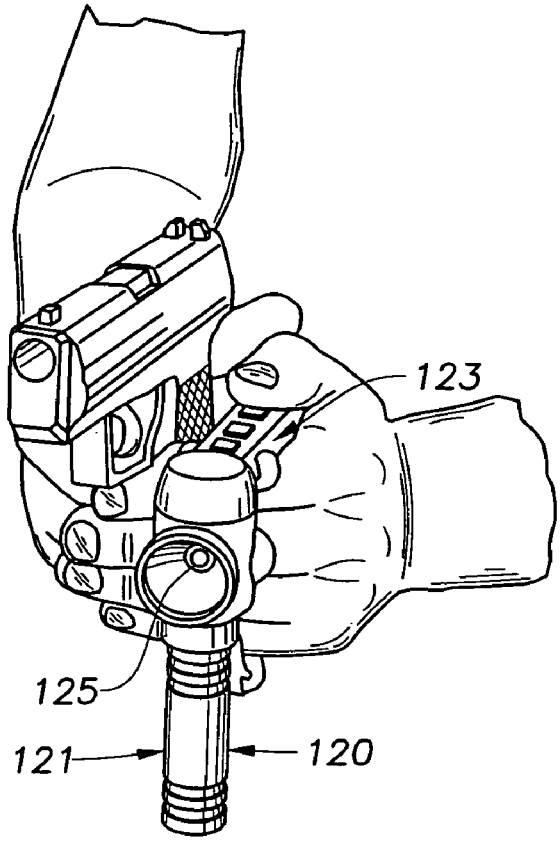
FIG. 30 is a perspective view of an alternative technique of using the flashlight device in conjunction with a hand gun.

As described above and shown in FIGS. 3, 6, 28 and 29, the user benefits significantly while shooting with the flashlight device of the present invention in the tactical position. However, users will also find the design to be beneficial when shooting with the flashlight device 120 in the utility position (light source 125 oriented in substantial alignment with the linking member 123) as shown in FIG. 30. In certain circumstances, the user may need to quickly access the flashlight device 120 to illuminate a target with the flashlight device in the utility position. Since the flashlight device 120 may be holstered on the user's belt in the utility position, the technique shown in FIG. 30 may be preferred.

Figure 31:
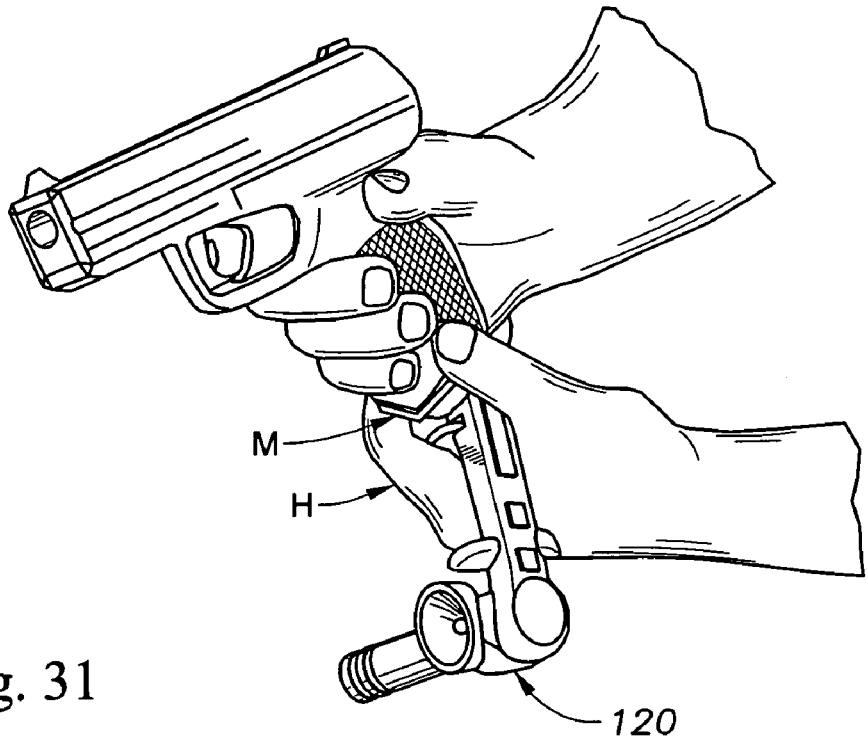
FIG. 31 is a perspective view illustrating the removal or insertion of a firearm's magazine with the flashlight device attached to the user's hand.
Figure 32:
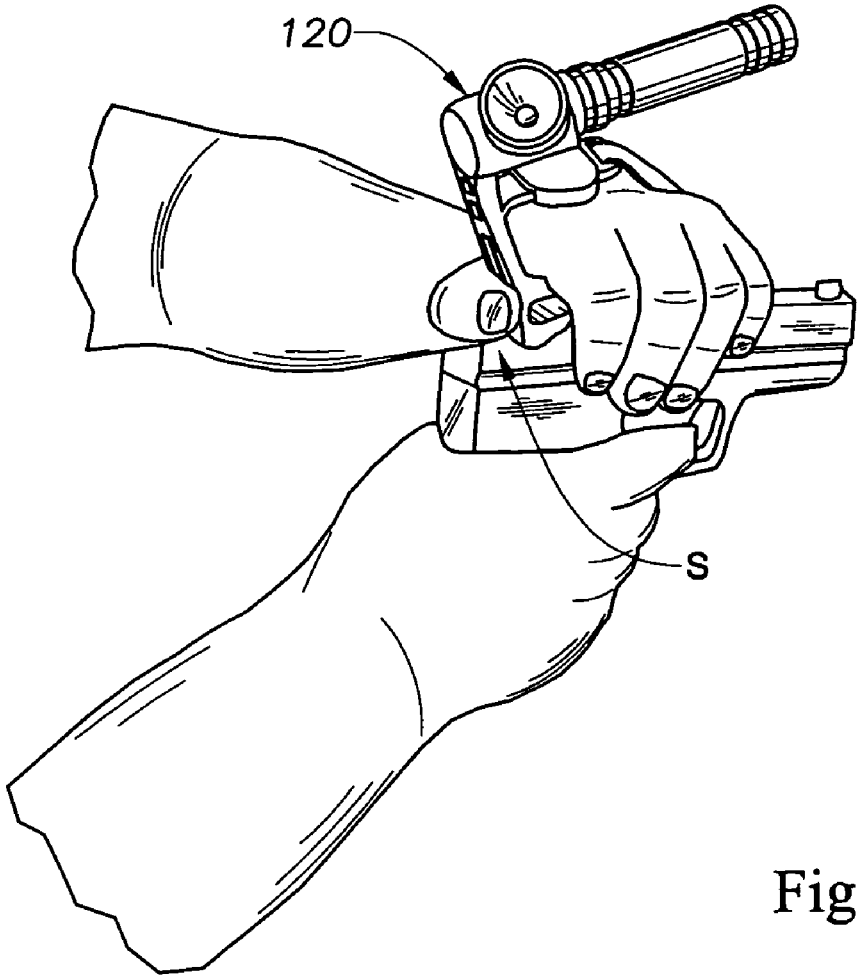
FIG. 32 is a perspective view illustrating the operation of a firearm's slide with the flashlight device attached to the user's hand.

FIGS. 31 and 32 show some basic gun handling maneuvers and how the flashlight device according to the present invention does not inhibit such maneuvers. With the flashlight device 120 attached to the user's non-shooting hand H, FIG. 31 illustrates the removal or insertion of a firearm's magazine M and FIG. 32 illustrates the operation of a firearm's slide S. It is vitally important to the user to be able to do such maneuvers quickly and easily and without interference by the flashlight device 120.

The flashlight device of the present invention provides the user with multiple ergonomic and tactical advantages when used to perform routine activities and in combination with a firearm. These advantages include:

- Ability to use hands freely to manipulate objects;
- Faster target acquisition and superior illumination;
- Improved accuracy when firing a weapon in low light situations;
- Improved stability on firearm recoil;
- Fingers remain free to provide the correct two-handed grip on the weapon or to perform other actions such as accessing spare clips, radios, or handcuffs;
- Light housing rotates to provide right, left, and forward lighting positions;
- Ambidextrous design and ergonomic grip accommodates all users regardless of hand preference or size;
- Belt mounted holster provides easy access and will swivel to provide hands-free forward illumination when holstered in the forward position; and
- Overall ergonomic superiority compared to conventional flashlight designs.

While the invention has been described in detail above with reference to specific embodiments, it will be understood that modifications and alterations in the embodiments disclosed may be made by those practiced in the art without departing from the spirit and scope of the invention. All such modifications and alterations are intended to be covered. In addition, all publications cited herein are indicative of the level of skill in the art and are hereby incorporated by reference in their entirety as if each had been individually incorporated by reference and fully set forth.

We claim:

1. A flashlight apparatus comprising:

a housing assembly having a light-emitting portion and a battery-containing portion;

a hand stabilizer assembly attached to said housing assembly at a first portion of said housing assembly, said hand stabilizer assembly including a hand pad for contacting the back of a user's hand during use; and a strap attached to said hand stabilizer assembly and attached to a second portion of said housing assembly.

2. The apparatus of claim 1, wherein a hand receiving opening is defined by said housing assembly, said hand stabilizer assembly and said strap.

3. The apparatus of claim 2, wherein said strap is adjustable in length.

4. The apparatus of claim 1, wherein said hand stabilizer assembly adjustably attaches to a plurality of locations on said housing assembly.

5. The apparatus of claim 1, wherein said housing assembly includes a handle and said second portion is on said handle.

6. The apparatus of claim 5, wherein said housing assembly includes a linking member connected to said handle and said hand stabilizer assembly is attached to said linking member.

7. The apparatus of claim 6, further comprising a switch positioned on said linking member.

8. The apparatus of claim 7, wherein said switch is arranged and designed for depression with a thumb of a user's hand while the hand contacts said handle.

9. A flashlight apparatus comprising:

a housing assembly having a light-emitting portion and a battery-containing portion, and having a linking member connected to a handle;

a hand stabilizer assembly an ached to said linking member; and a strap attached to said hand stabilizer assembly and to said handle, wherein said hand stabilizer assembly includes a hand pad, wherein said hand pad and said handle are adapted to snugly receive a portion of the user's hand.

10. The apparatus of claim 9, wherein said handle is pivotally connected to said linking member and said hand pad is pivotally connected to a clip of said hand stabilizer assembly.

11. The flashlight apparatus of claim 9, wherein said light-emitting portion is positionable relative to said handle at two discrete locations.

12. The flashlight apparatus of claim 11, wherein a first of said discrete locations is provided at a connection between said light-emitting portion and said linking member.

13. The flashlight apparatus of claim 12, wherein a second of said discrete locations is positioned at a connection between said handle and said linking member.

14. The flashlight apparatus of claim 9, further comprising a switch positioned on said linking member.

15. The flashlight apparatus of claim 14, wherein said switch is arranged and designed for depression with a thumb of a user's hand while the hand contacts said handle.

* * * * *